US011548752B2

(12) United States Patent
Hari et al.

(10) Patent No.: US 11,548,752 B2
(45) Date of Patent: *Jan. 10, 2023

(54) SHEET PROCESSING APPARATUS AND IMAGE FORMING SYSTEM

(71) Applicants: Kenji Hari, Kanagawa (JP); Manabu Yamanaka, Kanagawa (JP); Nagayasu Yoshida, Kanagawa (JP)

(72) Inventors: Kenji Hari, Kanagawa (JP); Manabu Yamanaka, Kanagawa (JP); Nagayasu Yoshida, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/128,832

(22) Filed: Dec. 21, 2020

(65) Prior Publication Data

US 2021/0107761 A1 Apr. 15, 2021

Related U.S. Application Data

(63) Continuation of application No. 15/972,327, filed on May 7, 2018, now Pat. No. 10,894,690, which is a (Continued)

(30) Foreign Application Priority Data

May 9, 2014 (JP) ..... 2014-098058

(51) Int. Cl.
*B65H 37/06* (2006.01)
*B65H 45/30* (2006.01)
(Continued)

(52) U.S. Cl.
CPC ..... *B65H 45/30* (2013.01); *B65H 29/60* (2013.01); *B65H 37/06* (2013.01); *B65H 45/04* (2013.01);
(Continued)

(58) Field of Classification Search
CPC ..... B65H 45/30; B65H 45/14; B65H 37/06; B65H 29/60; B65H 45/04
See application file for complete search history.

(56) References Cited

U.S. PATENT DOCUMENTS 5,377,965 A 1/1995 Mandel et al.
6,709,375 B2 3/2004 Groenenberg et al.
(Continued)

FOREIGN PATENT DOCUMENTS

JP S59-46945 U 3/1984
JP 2004-075271 A 3/2004
(Continued)

OTHER PUBLICATIONS

Office Action for Corresponding Japanese Application No. 2014-098058 dated Jan. 16, 2018.

*Primary Examiner* — Patrick H Mackey
(74) *Attorney, Agent, or Firm* — Harness, Dickey & Pierce, P.L.C.

(57) ABSTRACT

A sheet processing apparatus is configured to press a fold line that is formed on a sheet. The sheet processing apparatus includes: a sheet supporting unit configured to support the sheet in a pressing direction for pressing the fold line; a pressing unit configured to press the fold line that is formed on the sheet that is supported by the sheet supporting unit; and a pressing-force generating unit configured to generate a pressing force for pressing the sheet supporting unit against the pressing unit at a central part in a direction along which the fold line is formed.

15 Claims, 36 Drawing Sheets

Related U.S. Application Data continuation of application No. 15/479,794, filed on Apr. 5, 2017, now Pat. No. 9,994,414, which is a continuation of application No. 14/699,303, filed on Apr. 29, 2015, now Pat. No. 9,637,342.

(51) Int. Cl.

| | |
|---|---|
| ***B65H 29/60*** | (2006.01) |
| ***B65H 45/14*** | (2006.01) |
| ***B65H 45/04*** | (2006.01) |

(52) U.S. Cl.

CPC ..... *B65H 45/14* (2013.01); *B65H 2301/4493* (2013.01); *B65H 2403/72* (2013.01); *B65H 2403/942* (2013.01); *B65H 2404/1118* (2013.01); *B65H 2404/153* (2013.01); *B65H 2404/1521* (2013.01); *B65H 2404/61* (2013.01); *B65H 2404/612* (2013.01); *B65H 2404/6942* (2013.01); *B65H 2511/11* (2013.01); *B65H 2511/212* (2013.01); *B65H 2513/10* (2013.01); *B65H 2513/11* (2013.01); *B65H 2513/512* (2013.01); *B65H 2557/242* (2013.01); *B65H 2701/1123* (2013.01); *B65H 2701/11231* (2013.01); *B65H 2701/11232* (2013.01); *B65H 2701/11234* (2013.01); *B65H 2701/13212* (2013.01); *B65H 2801/27* (2013.01)

(56) References Cited

U.S. PATENT DOCUMENTS

| | | | | |
|---|---|---|---|---|
| 6,905,118 | B2 | 6/2005 | Yamada et al. | |
| 7,673,862 | B2 | 3/2010 | Kushida et al. | |
| 8,317,180 | B2 | 11/2012 | Kawaguchi | |
| 8,366,095 | B2 | 2/2013 | Urano et al. | |
| 8,616,541 | B2 | 12/2013 | Hayashi | |
| 9,199,822 | B1 | 12/2015 | Pegg | |
| 9,555,998 | B2 * | 1/2017 | Watanabe | B65H 45/16 |
| 9,993,987 | B2 * | 6/2018 | Suzuki | B65H 45/14 |
| 10,059,558 | B2 * | 8/2018 | Suzuki | B65H 45/30 |
| 10,363,757 | B2 * | 7/2019 | Iwata | B41J 11/04 |
| 10,710,834 | B2 * | 7/2020 | Hidaka | B65H 45/14 |
| 10,894,690 | B2 * | 1/2021 | Hari | B65H 29/60 |
| 10,953,622 | B2 * | 3/2021 | Suzuki | B65H 45/30 |
| 10,974,923 | B2 * | 4/2021 | Suzuki | B65H 45/30 |
| 2004/0104525 | A1 | 6/2004 | Suzuki et al. | |
| 2010/0007071 | A1 | 1/2010 | Hayashi | |
| 2010/0008709 | A1 | 1/2010 | Hayashi et al. | |
| 2010/0221052 | A1 | 9/2010 | Mizuno et al. | |
| 2014/0141956 | A1 | 5/2014 | Suzuki et al. | |
| 2014/0147184 | A1 | 5/2014 | Kunieda et al. | |
| 2014/0171283 | A1 | 6/2014 | Furuhashi et al. | |
| 2014/0179504 | A1 | 6/2014 | Nakada et al. | |
| 2014/0336031 | A1 | 11/2014 | Suzuki et al. | |
| 2014/0364295 | A1 | 12/2014 | Watanabe et al. | |
| 2015/0031520 | A1 | 1/2015 | Nakada et al. | |
| 2015/0183612 | A1 * | 7/2015 | Awano | B65H 45/147 493/454 |
| 2015/0225201 | A1 | 8/2015 | Watanabe et al. | |

FOREIGN PATENT DOCUMENTS

| | | | |
|---|---|---|---|
| JP | 2008-189404 | A | 8/2008 |
| JP | 2010-036333 | A | 2/2010 |
| JP | 2010-036576 | A | 2/2010 |
| JP | 2011-121739 | A | 6/2011 |
| JP | 2011-157188 | A | 8/2011 |

* cited by examiner

SHEET PROCESSING APPARATUS AND IMAGE FORMING SYSTEM

CROSS-REFERENCE TO RELATED APPLICATIONS

The present application is a continuation of U.S. application Ser. No. 15/972,327 filed on May 7, 2018, which is a continuation of U.S. application Ser. No. 15/479,794 filed on Apr. 5, 2017, which is a continuation of U.S. application Ser. No. 14/699,303 filed on Apr. 29, 2015, which claims priority to Japanese Patent Application No. 2014-098058 filed in Japan on May 9, 2014, the entire disclosures of each of which are hereby incorporated by reference herein.

BACKGROUND OF THE INVENTION

1. Field of the Invention

The present invention relates to a sheet processing apparatus and an image forming system and, more particularly, to a sheet folding operation.

2. Description of the Related Art

In recent years, there has been a tendency to promote information computerization, and image processing apparatuses, such as printers or facsimile machines that are used to output computerized information or scanners that are used to computerize documents, are essential apparatuses. Such an image processing apparatus has an image capturing function, an image forming function, a communication function, or the like, so that it is often configured as a multifunction peripheral that can be used as a printer, facsimile machine, scanner, or copier.

Out of the above multifunction peripherals, there are known multifunction peripherals that include a folding processing apparatus that, after an image formation is performed on a fed sheet so that an image is drawn, performs a folding operation on the sheet on which the image has been formed. If a sheet is subjected to a folding operation by the above folding processing apparatus, and if it remains so, a fold line is loose and incomplete, which results in a state where the height of the folded part is high.

Therefore, out of the above multifunction peripherals, there are known multifunction peripherals that include, in addition to a folding processing apparatus, a fold-enhancing apparatus that performs a fold-enhancing operation to enhance a fold line that is formed during a folding operation by pressing the fold line, whereby the fold line is enhanced and the height of the folded part is reduced (for example, see Japanese Patent Application Laid-open No. 2004-075271).

Such a fold-enhancing apparatus includes a pair of fold-enhancing rollers that are made up of two fold-enhancing rollers that are laterally bridged in a direction parallel to a fold line that is formed by the folding processing apparatus, and the pair of fold-enhancing rollers nip the fold line, which is formed by the folding processing apparatus, on both sheet surfaces, thereby pressing the fold line.

Alternatively, such a fold-enhancing apparatus includes a fold-enhancing roller, which is laterally bridged in a direction parallel to a fold line formed by the folding processing apparatus, and a sheet supporting plate that supports a sheet on the sheet surface, and the fold-enhancing roller and the sheet supporting plate nip the fold line that is formed by the folding processing apparatus on both sheet surfaces, thereby pressing the fold line.

Here, in the fold-enhancing apparatus, a force acts to press the fold-enhancing roller and the sheet supporting plate against each other at both ends thereof in a main-scanning direction, whereby a pressing force is generated over the entire area in the main-scanning direction.

Therefore, in the above fold-enhancing apparatus, when a fold line is pressed, resilience is generated from the sheet in response to the pressing force; however, in the vicinity of both ends in the main-scanning direction, the force for pressing the fold-enhancing roller and the sheet supporting plate against each other acts as a force that resists the above-described resilience, and therefore a fold line can be sufficiently pressed with the force even though the resilience is received.

However, there is a problem in that there is no force that can resist the above-described resilience in the vicinity of the central part in the main-scanning direction; therefore, if resilience is received, the fold-enhancing roller and the sheet supporting plate are bent in the direction opposite to the pressing direction, and a fold line cannot be sufficiently pressed.

In view of the above, there is a need to effectively enhance a fold line that is formed on a sheet.

SUMMARY OF THE INVENTION

It is an object of the present invention to at least partially solve the problems in the conventional technology.

A sheet processing apparatus is configured to press a fold line that is formed on a sheet. The sheet processing apparatus includes: a sheet supporting unit configured to support the sheet in a pressing direction for pressing the fold line; a pressing unit configured to press the fold line that is formed on the sheet that is supported by the sheet supporting unit; and a pressing-force generating unit configured to generate a pressing force for pressing the sheet supporting unit against the pressing unit at a central part in a direction along which the fold line is formed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the present invention is explained below in detail with reference to the drawings. In the present embodiment, an explanation is given by using, for example, an image forming apparatus that, after forming an image on a fed sheet, such as paper, performs a folding operation on the sheet on which the image has been formed so as to form a fold line in a main-scanning direction and that performs a fold-enhancing operation by pressing the formed fold line so as to enhance the fold line, whereby the height of the folded part is reduced.

Furthermore, the image forming apparatus according to the present embodiment includes a fold-enhancing roller that is laterally bridged in a main-scanning direction and a sheet supporting plate that supports the sheet surface of a sheet, and the fold-enhancing roller and the sheet supporting plate nip a fold line, which is formed by a folding processing apparatus, on both sheet surfaces so that the fold line is pressed.

In the image forming apparatus that is configured in this manner, it is one feature of the present embodiment that the force for pressing the sheet supporting plate and the fold-enhancing roller against each other acts near the central part thereof in a main-scanning direction. Thus, the image forming apparatus according to the present embodiment can uniformly generate a pressing force over the entire area in a main-scanning direction. Therefore, with the image forming apparatus according to the present embodiment, it is possible to effectively enhance a fold line that is formed on a sheet.

Figure 1:
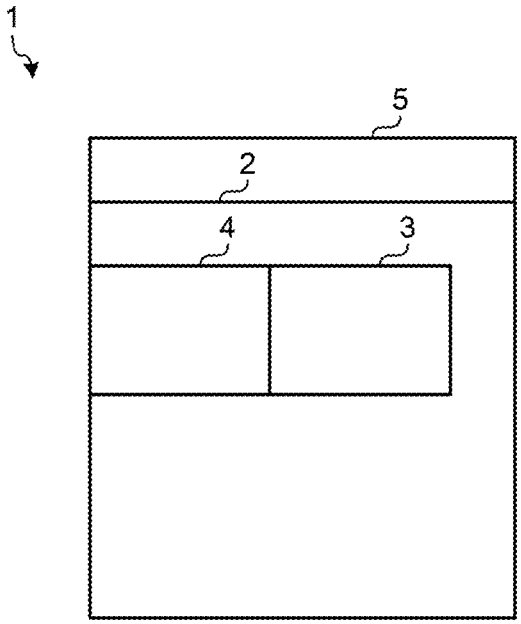
FIG. 1 is a diagram that illustrates the overall configuration of an image forming apparatus according to an embodiment of the present invention in a simplified manner.

First, an explanation is given, with reference to FIG. 1, of the overall configuration of an image forming apparatus 1 according to the present embodiment. FIG. 1 is a diagram that illustrates the overall configuration of the image forming apparatus 1 according to the present embodiment in a simplified manner. As illustrated in FIG. 1, the image forming apparatus 1 according to the present embodiment includes an image forming unit 2, a folding processing unit 3, a fold-enhancing processing unit 4, and a scanner unit 5.

The image forming unit 2 generates CMYK (cyan, magenta, yellow, and key plate) drawing information based on input image data and, in accordance with the generated drawing information, conducts an image formation output on a fed sheet. The folding processing unit 3 performs a folding operation on a sheet that is conveyed from the image forming unit 2 and that has an image formed thereon. The fold-enhancing processing unit 4 performs a fold-enhancing operation on a fold line that is formed on the sheet that is conveyed from the folding processing unit 3 and on which the folding operation has been performed. That is, according to the present embodiment, the fold-enhancing processing unit 4 serves as a sheet processing apparatus.

The scanner unit 5 computerizes an original document by reading the original document by using a linear image sensor in which multiple photo diodes are arranged in a row and, in parallel to them, light receiving elements, such as charge coupled devices (CCDs) or complementary metal oxide semiconductor (COMS) image sensors, are arranged. Furthermore, the image forming apparatus 1 according to the present embodiment is a multifunction peripheral (MFP) that has an image capturing function, an image forming function, a communication function, or the like, so that it can be used as a printer, facsimile machine, scanner, or copier.

Figure 2:
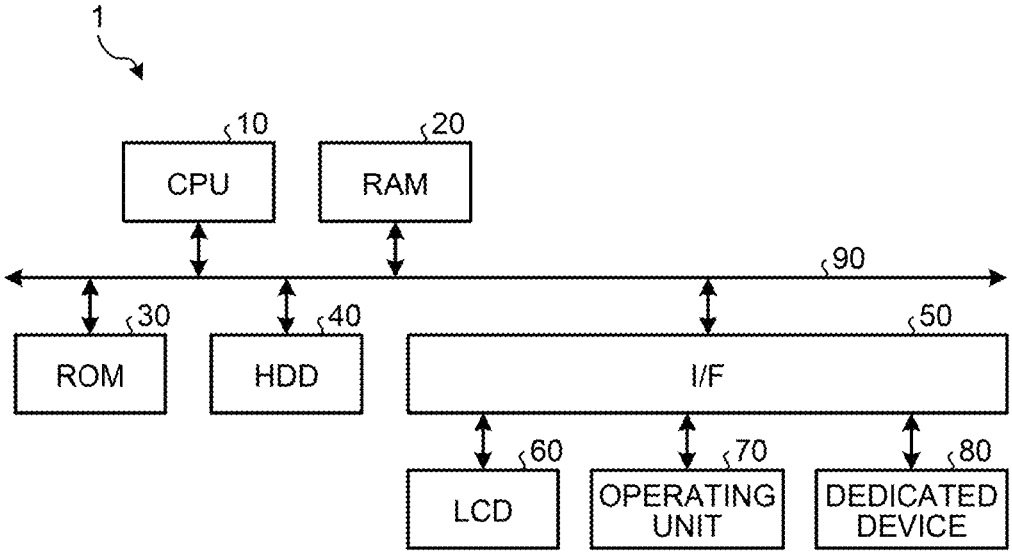
FIG. 2 is a block diagram that schematically illustrates a hardware configuration of the image forming apparatus according to the embodiment of the present invention.

Next, an explanation is given, with reference to FIG. 2, of a hardware configuration of the image forming apparatus 1 according to the present embodiment. FIG. 2 is a block diagram that schematically illustrates a hardware configuration of the image forming apparatus 1 according to the present embodiment. Furthermore, in addition to the hardware configuration illustrated in FIG. 2, the image forming apparatus 1 includes the engines for implementing a scanner, a printer, a folding operation, a fold-enhancing operation, or the like.

As illustrated in FIG. 2, the image forming apparatus 1 according to the present embodiment has the same configuration as that of a typical server, personal computer (PC), or the like. Specifically, in the image forming apparatus 1 according to the present embodiment, a central processing unit (CPU) 10, a random access memory (RAM) 20, a read only memory (ROM) 30, a hard disk drive (HDD) 40, and an I/F 50 are connected to one another via a bus 90. Furthermore, the I/F 50 is connected to a liquid crystal display (LCD) 60, an operating unit 70, and a dedicated device 80.

The CPU 10 is a calculating unit, and it controls the overall operation of the image forming apparatus 1. The RAM 20 is a volatile storage medium from and to which information can be read and written at a high speed, and it is used as a working area when the CPU 10 processes information. The ROM 30 is a non-volatile read-only storage medium, and it stores programs, such as firmware. The HDD 40 is a non-volatile storage medium from and to which information can be read and written, and it stores an operating system (OS), various control programs, application programs, and/or the like.

The I/F 50 connects to the bus 90, various types of hardware, networks, and/or the like, and controls them. The LCD 60 is a visual user interface by which a user checks the state of the image forming apparatus 1. The operating unit 70 is a user interface, such as a keyboard or mouse, by which a user inputs information to the image forming apparatus 1.

The dedicated device 80 is the hardware for implementing dedicated functions in the image forming unit 2, the folding processing unit 3, the fold-enhancing processing unit 4, and the scanner unit 5 and, in the image forming unit 2, it is a plotter device that conducts an image formation output on a sheet surface. Furthermore, in the folding processing unit 3, it is a conveying mechanism for conveying sheets and a folding processing mechanism for folding a conveyed sheet.

Furthermore, in the fold-enhancing processing unit 4, it is a fold-enhancing processing mechanism for enhancing a fold line of a sheet that is conveyed after the folding processing unit 3 performs a folding operation. Moreover, in the scanner unit 5, it is a reading device that reads an image that is presented on a sheet surface. The configuration of the fold-enhancing processing mechanism that is included in the fold-enhancing processing unit 4 is one of the features of the present embodiment.

In such hardware configuration, a program that is stored in a storage medium, such as the ROM 30, the HDD 40, or an undepicted optical disk is read out into the RAM 20, and the CPU 10 performs a calculation in accordance with the program that is loaded into the RAM 20, whereby a software control unit is implemented. A functional block for implementing the functions of the image forming apparatus 1 according to the present embodiment is implemented by using a combination of the hardware and the software control unit that is implemented as above.

Figure 3:
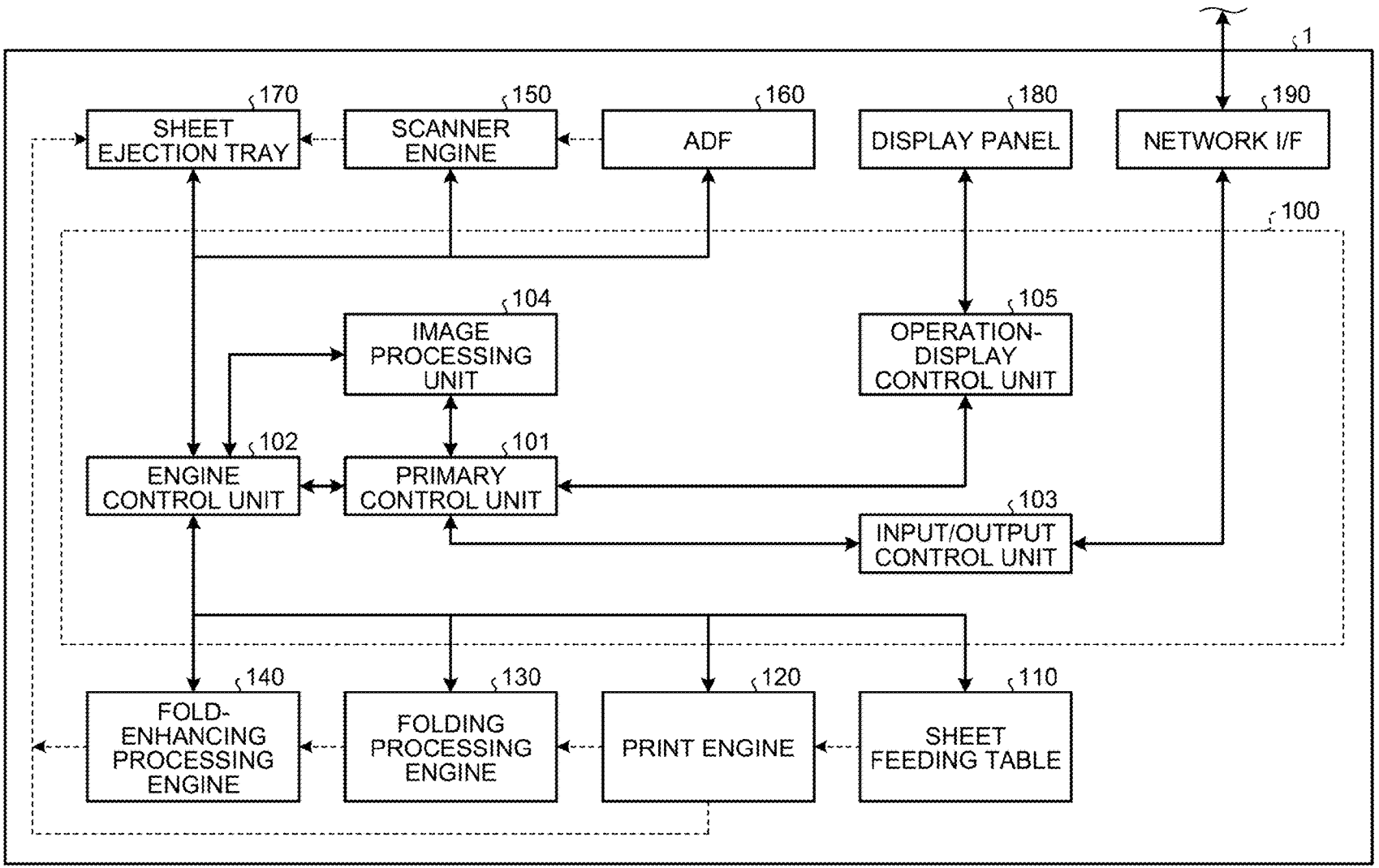
FIG. 3 is a block diagram that schematically illustrates the functional configuration of the image forming apparatus according to the embodiment of the present invention.

Next, an explanation is given, with reference to FIG. 3, of the functional configuration of the image forming apparatus 1 according to the present embodiment. FIG. 3 is a block diagram that schematically illustrates the functional configuration of the image forming apparatus 1 according to the present embodiment. Incidentally, in FIG. 3, electric connections are indicated by the arrows of solid lines, and the flow of a sheet or a bundle of documents is indicated by the arrows of dashed lines.

As illustrated in FIG. 3, the image forming apparatus 1 according to the present embodiment includes a controller 100, a sheet feeding table 110, a print engine 120, a folding processing engine 130, a fold-enhancing processing engine 140, a scanner engine 150, an automatic document feeder (ADF) 160, a sheet ejection tray 170, a display panel 180, and a network I/F 190. The controller 100 further includes a primary control unit 101, an engine control unit 102, an input/output control unit 103, an image processing unit 104, and an operation-display control unit 105.

The sheet feeding table 110 feeds a sheet to the print engine 120 that is an image forming section. The print engine 120 is the image forming section that is included in the image forming unit 2, and it conducts an image formation output on a sheet that is conveyed from the sheet feeding table 110 so as to draw an image. As a specific form of the print engine 120, it is possible to use an image forming mechanism that uses an ink jet system, an image forming mechanism that uses an electrophotographic system, or the like. The image-formed sheet on which an image has been drawn by the print engine 120 is conveyed to the folding processing unit 3 or is ejected to the sheet ejection tray 170.

The folding processing engine 130 is included in the folding processing unit 3, and it performs a folding operation on the image-formed sheet that is conveyed from the image forming unit 2. The folding-processed sheet, on which a folding operation has been performed by the folding processing engine 130, is conveyed to the fold-enhancing processing unit 4. The fold-enhancing processing engine 140 is included in the fold-enhancing processing unit 4, and it performs a fold-enhancing operation on a fold line that is formed on the folding-processed sheet that is conveyed from the folding processing engine 130. The fold-enhancing processed sheet, on which a fold-enhancing operation has been performed by the fold-enhancing processing engine 140, is ejected to the sheet ejection tray 170 or is conveyed to an undepicted post-processing unit that conducts post-processing, such as stapling, punching, or bookbinding processing.

The ADF 160 is included in the scanner unit 5, and it automatically conveys an original document to the scanner engine 150 that is an original-document reading section. The scanner engine 150 is included in the scanner unit 5, and it is an original-document reading section that includes a photoelectric conversion element that converts optical information into electric signals; thus, it optically scans and reads an original document that is automatically conveyed by the ADF 160 or an original document that is placed on an undepicted platen glass to generate image information. After an original document is automatically conveyed by the ADF 160 and is read by the scanner engine 150, it is ejected to the sheet ejection tray that is included in the ADF 160.

The display panel 180 is an output interface that visually displays the state of the image forming apparatus 1, and it is also an input interface that is used as a touch panel for a user to directly operate the image forming apparatus 1 or for inputting information to the image forming apparatus 1. Specifically, the display panel 180 has a function to display an image for which a user's operation is received. The display panel 180 is implemented by using the LCD 60 and the operating unit 70 that are illustrated in FIG. 2.

The network I/F 190 is an interface by which the image forming apparatus 1 communicates with other devices, such as an administrator-dedicated terminal, via a network, and Ethernet (registered trademark) or a universal serial bus (USB) interface, Bluetooth (registered trademark), Wireless Fidelity (Wi-Fi), or FeliCa (registered trademark) interface, or the like, are used. The network I/F 190 is implemented by the I/F 50 that is illustrated in FIG. 2.

The controller 100 is configured by using a combination of software and hardware. Specifically, control programs, such as firmware, stored in a non-volatile storage medium, such as the ROM 30 or the HDD 40, are loaded into the RAM 20, and the controller 100 is implemented by using the software control unit that is implemented when the CPU 10 performs calculations in accordance with the programs and hardware, such as an integrated circuit. The controller 100 serves as a control unit that performs the overall control of the image forming apparatus 1.

The primary control unit 101 performs a function to control each unit included in the controller 100 and gives a command to each unit of the controller 100. Furthermore, the primary control unit 101 controls the input/output control unit 103 so as to access other devices via the network I/F 190 and a network. The engine control unit 102 controls or drives driving units, such as the print engine 120, the folding processing engine 130, the fold-enhancing processing engine 140, or the scanner engine 150. The input/output control unit 103 inputs, to the primary control unit 101, a signal or command that is input via the network I/F 190 and a network.

Under control of the primary control unit 101, the image processing unit 104 generates drawing information on the basis of document data or image data that is included in an input print job. The drawing information is data, such as CMYK bitmap data, and it is the information for drawing an image that is to be formed during an image forming operation by the print engine 120 that is an image forming section. Furthermore, the image processing unit 104 processes captured-image data that is input from the scanner engine 150 and generates image data. The image data is the information that, as a result of a scanner operation, is stored in the image forming apparatus 1 or is transmitted to other devices via the network I/F 190 and a network. The operation-display control unit 105 displays information on the display panel 180 or notifies the primary control unit 101 of the information that is input via the display panel 180.

Next, an explanation is given, with reference to FIGS. 4A to 6C, of an operation example when the folding processing unit 3 and the fold-enhancing processing unit 4 according to the present embodiment perform a folding operation and a fold-enhancing operation. FIGS. 4A to 6C are cross-sectional views that illustrate, in a main-scanning direction, the folding processing unit 3 and the fold-enhancing processing unit 4 according to the present embodiment when the folding processing unit 3 performs a folding operation and the fold-enhancing processing unit 4 performs a fold-enhancing operation. Incidentally, an operation of each operating unit that is described below is performed under the control of the primary control unit 101 and the engine control unit 102.

Figure 4A:
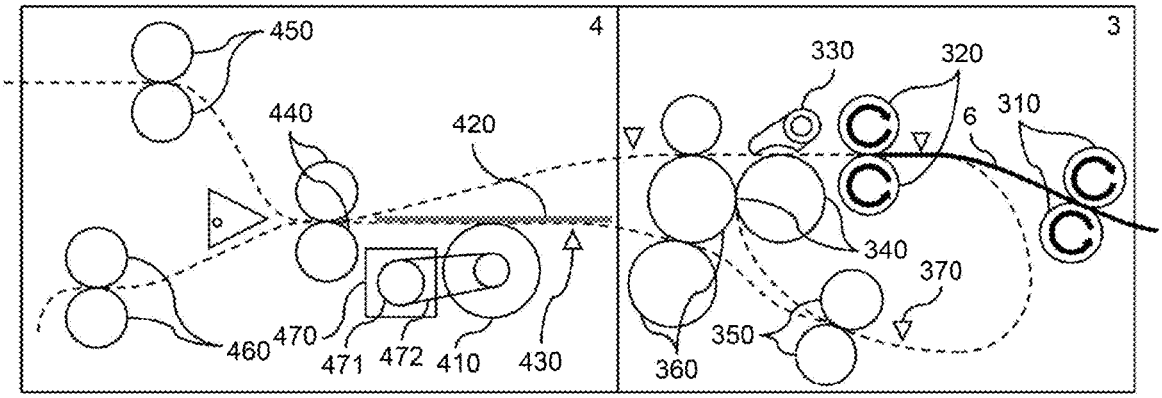
FIGS. 4A to 4C are cross-sectional views that illustrate, in a main-scanning direction, a folding processing unit and a fold-enhancing processing unit according to the embodiment of the present invention when the folding processing unit performs a folding operation and the fold-enhancing processing unit performs a fold-enhancing operation.

When the image forming apparatus 1 according to the present embodiment performs a folding processing operation by using the folding processing unit 3, the folding processing unit 3 first uses a pair of registration rollers 320 to perform a registration correction on an image-formed sheet 6 that is conveyed by a pair of entry rollers 310 from the image forming unit 2 to the folding processing unit 3 and conveys it toward a conveyance-path switch claw 330 while controlling the conveyance timing, as illustrated in FIG. 4A.

Figure 4B:
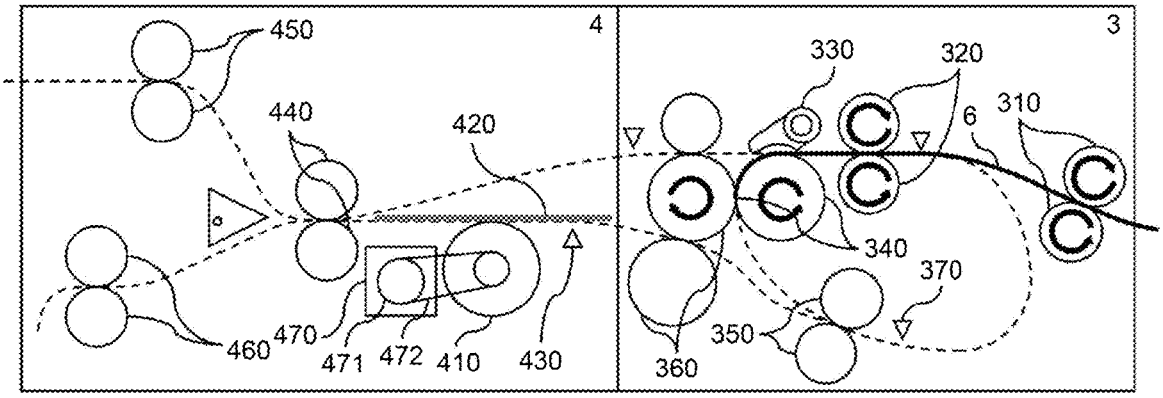
Figure 4C:
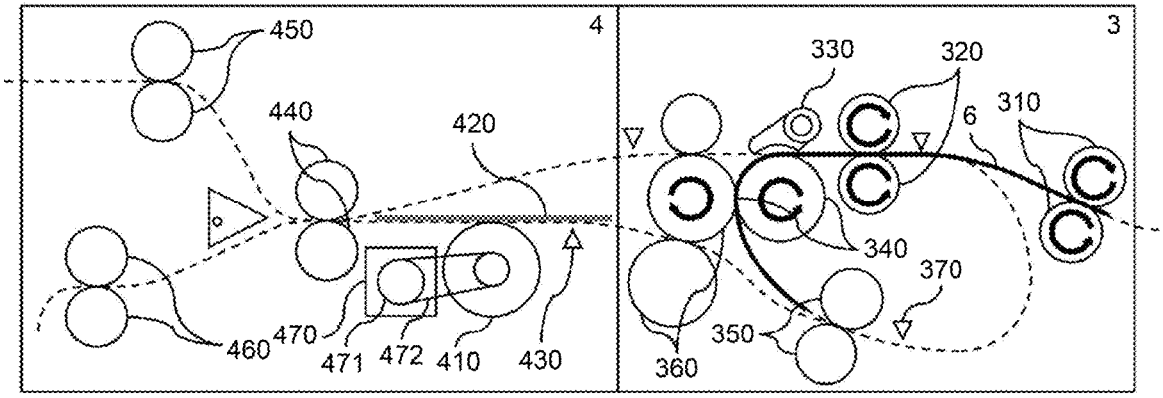

As illustrated in FIG. 4B, the folding processing unit 3 uses the conveyance-path switch claw 330 to guide, to a pair of first folding-processing conveyance rollers 340, the sheet 6 that is conveyed to the conveyance-path switch claw 330 by the pair of registration rollers 320. As illustrated in FIG. 4C, the folding processing unit 3 uses the pair of first folding-processing conveyance rollers 340 to convey, toward a pair of second folding-processing conveyance rollers 350, the sheet 6 that is guided to the pair of first folding-processing conveyance rollers 340 by the conveyance-path switch claw 330.

Figure 5A:
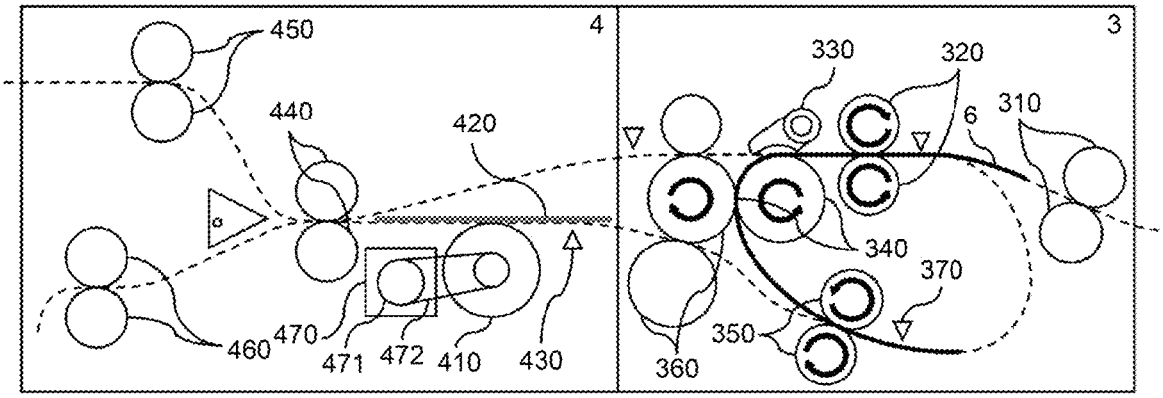
FIGS. 5A to 5C are cross-sectional views that illustrate, in a main-scanning direction, a folding processing unit and a fold-enhancing processing unit according to the embodiment of the present invention when the folding processing unit performs a folding operation and the fold-enhancing processing unit performs a fold-enhancing operation.
Figure 5B:
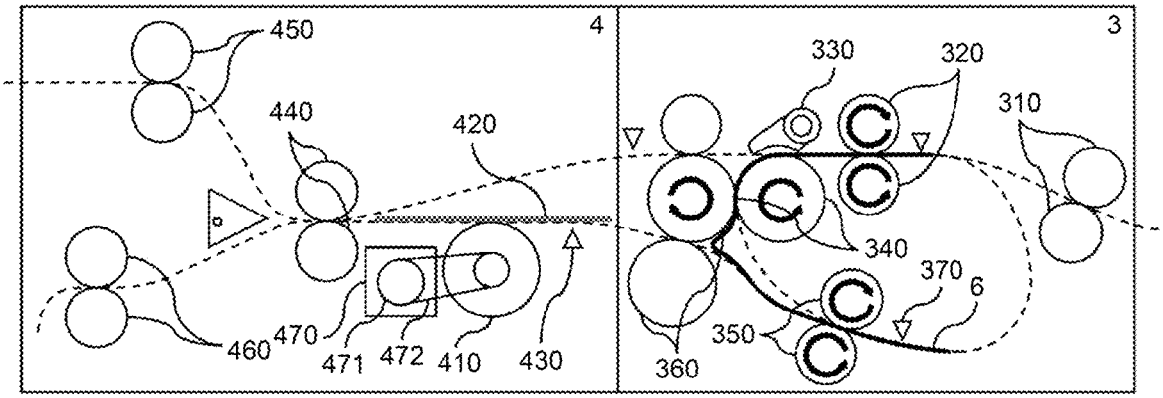

As illustrated in FIG. 5A, the folding processing unit 3 uses the pair of first folding-processing conveyance rollers 340 and the pair of second folding-processing conveyance rollers 350 to further convey the sheet 6 that is conveyed to the pair of second folding-processing conveyance rollers 350 by the pair of first folding-processing conveyance rollers 340. As illustrated in FIG. 5B, the folding processing unit 3 reverses the rotation direction of the pair of second folding-processing conveyance rollers 350 while controlling the timing for folding the sheet 6 at a predetermined position thereof so as to form a bend at the above-described predetermined position of the sheet 6 and uses the pair of first folding-processing conveyance rollers 340 and the pair of second folding-processing conveyance rollers 350 to convey the sheet 6 to a pair of fold-line forming conveyance rollers 360 without changing the position of the bend.

Here, the folding processing unit 3 uses the primary control unit 101 and the engine control unit 102 to control each unit on the basis of the conveying speed of the sheet 6 and the sensor information that is input from a sensor 370 in order to control the above-described timing.

Figure 5C:
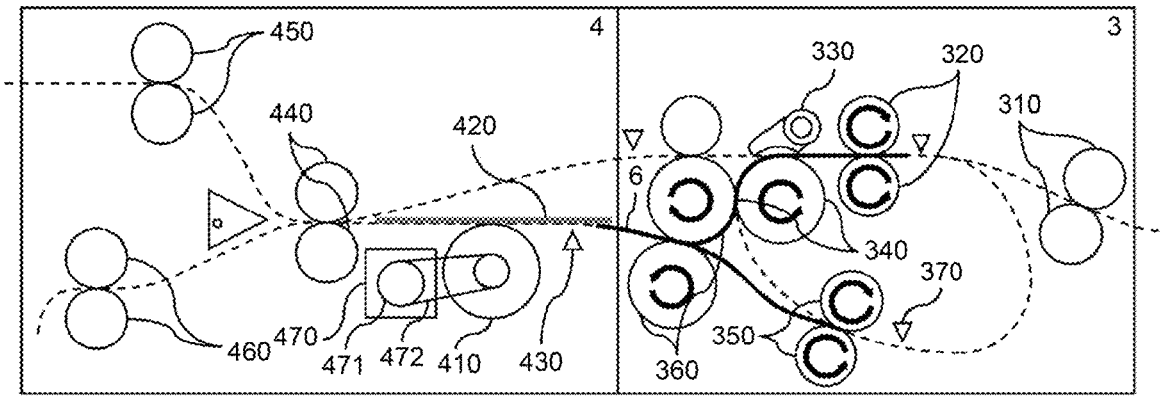

As illustrated in FIG. 5C, after the sheet 6 is conveyed to the pair of fold-line forming conveyance rollers 360 by the pair of second folding-processing conveyance rollers 350, the folding processing unit 3 rotates the pair of fold-line forming conveyance rollers 360 in a conveying direction so that the above-described bend of the sheet 6 is nipped and a fold line is formed at the above-described predetermined position, and the sheet 6 is conveyed toward the gap between a fold-enhancing roller 410 and a sheet supporting plate 420 in the fold-enhancing processing unit 4. Furthermore, as illustrated in FIGS. 4A to 5C, according to the present embodiment, one of the pair of first folding-processing conveyance rollers 340 also serves as one of the pair of fold-line forming conveyance rollers 360.

Figure 7:
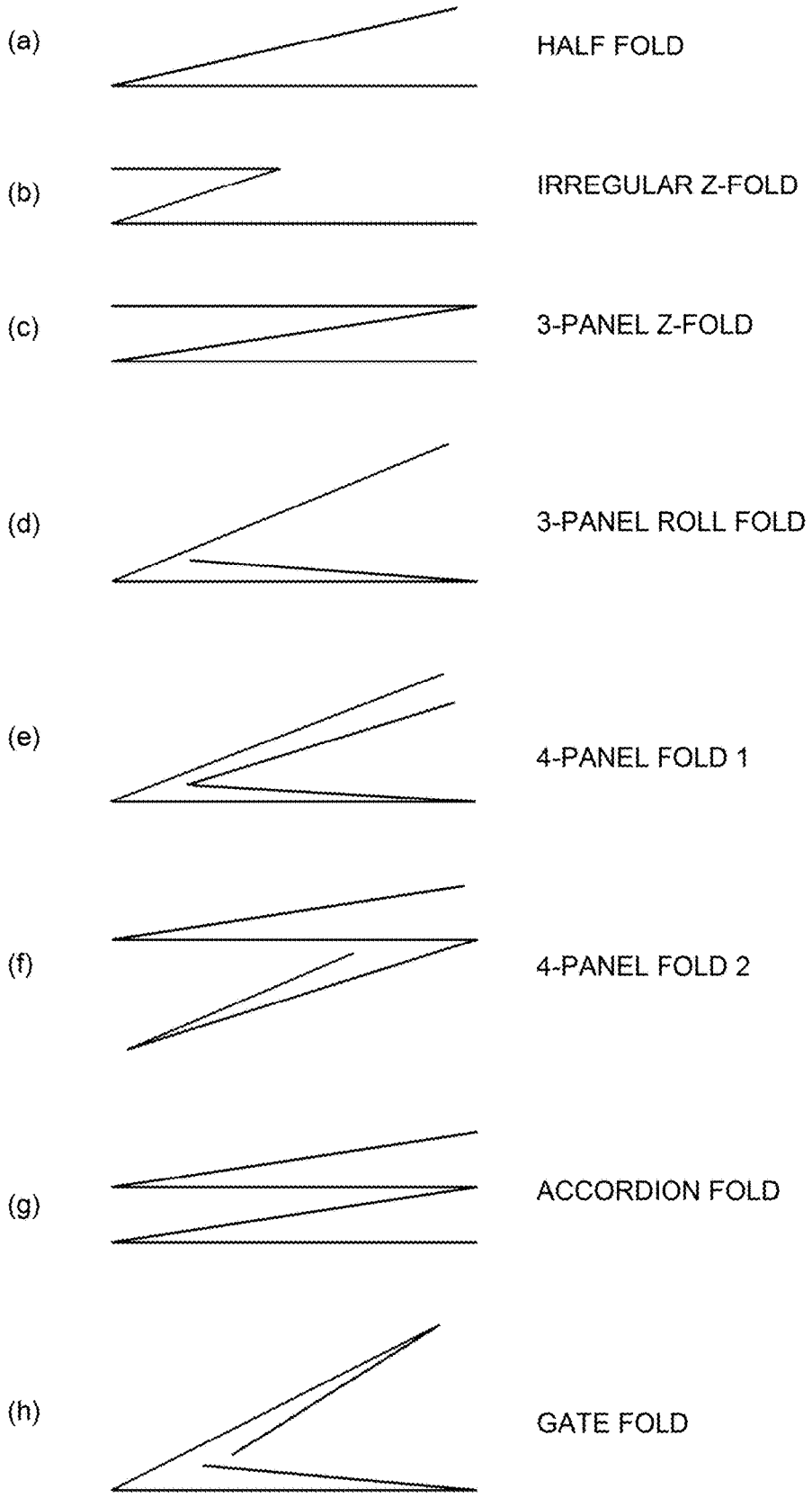
FIG. 7 is a diagram that illustrates examples of the form of a folding-processed sheet on which a folding operation has been performed by the folding processing unit according to the embodiment of the present invention.

Examples of the form of the sheet 6 on which a folding operation has been performed as described above are illustrated in FIG. 7. FIG. 7 is a diagram that illustrates examples of the form of the folding-processed sheet 6 on which a folding operation has been performed by the folding processing unit 3 according to the present embodiment.

Figure 6A:
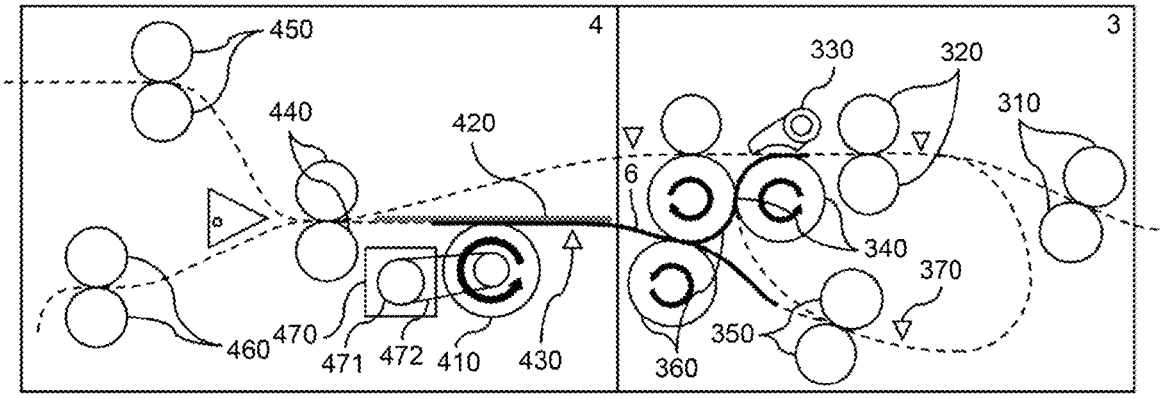
FIGS. 6A to 6C are cross-sectional views that illustrate, in a main-scanning direction, a folding processing unit and a fold-enhancing processing unit according to the embodiment of the present invention when the folding processing unit performs a folding operation and the fold-enhancing processing unit performs a fold-enhancing operation.

Then, as illustrated in FIG. 6A, the fold-enhancing processing unit 4 performs a fold-enhancing by using the sheet supporting plate 420 to support, in a pressing direction, the sheet 6 that is conveyed to the gap between the fold-enhancing roller 410 and the sheet supporting plate 420 by the pair of fold-line forming conveyance rollers 360 and by pressing a fold line formed on the sheet 6 while rotating the fold-enhancing roller 410 in a conveying direction. That is, according to the present embodiment, the fold-enhancing roller 410 serves as a pressing unit, and the sheet supporting plate 420 serves as a sheet supporting unit.

Here, the fold-enhancing processing unit 4 uses the primary control unit 101 and the engine control unit 102 to control each unit on the basis of the folding information on the type of folding that is performed by the folding processing unit 3, the sheet information on the size of the sheet 6, the conveying speed of the sheet 6, and the rotating speed of the fold-enhancing roller 410 so as to control the timing in which the sheet 6 is pressed. Alternatively, here, the fold-enhancing processing unit 4 uses the primary control unit 101 and the engine control unit 102 to control each unit on the basis of the conveying speed of the sheet 6, the rotating speed of the fold-enhancing roller 410, and the sensor information input from a sensor 430 so as to control the timing in which the sheet 6 is pressed.

Incidentally, as illustrated in FIGS. 4A to 6C, the fold-enhancing roller 410 is driven due to the driving force of a fold-enhancing roller drive motor 471 that is transmitted from a fold-enhancing roller drive device 470 via a timing belt 472, and furthermore the pair of fold-line forming conveyance rollers 360 is driven by an undepicted fold-line forming conveyance roller drive motor. Moreover, the fold-enhancing roller drive motor 471 and the fold-line forming conveyance roller drive motor are driven under the control of the engine control unit 102.

After the fold-enhancing processing unit 4 performs a fold-enhancing by using the fold-enhancing roller 410 to press a fold line that is formed on the sheet 6 as described above, the sheet 6 on which a fold-enhancing operation has been performed is conveyed toward a pair of fold-enhancing processing conveyance rollers 440.

Figure 6B:
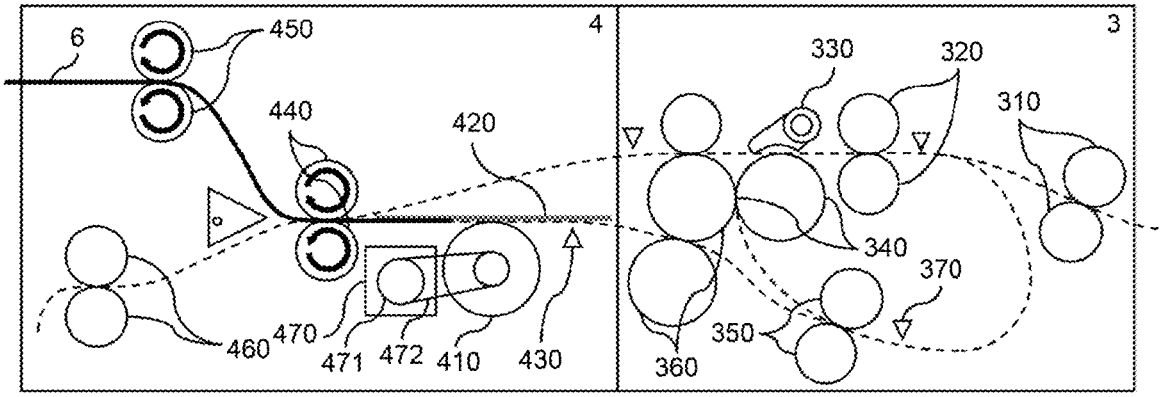

As illustrated in FIG. 6B, if the sheet 6 that is conveyed through the gap between the fold-enhancing roller 410 and the sheet supporting plate 420 and on which a fold-enhancing operation has been performed is directly ejected, the fold-enhancing processing unit 4 uses the pair of fold-enhancing processing conveyance rollers 440 to convey the sheet 6 toward a pair of sheet ejection rollers 450. Then, the fold-enhancing processing unit 4 ejects the sheet 6, which is conveyed to the pair of sheet ejection rollers 450 by the pair of fold-enhancing processing conveyance rollers 440 and on which a fold-enhancing operation has been performed, to the sheet ejection tray 170 by using the pair of sheet ejection rollers 450. Thus, a folding processing operation and a fold-enhancing processing operation by the image forming apparatus 1 according to the present embodiment are completed.

Figure 6C:
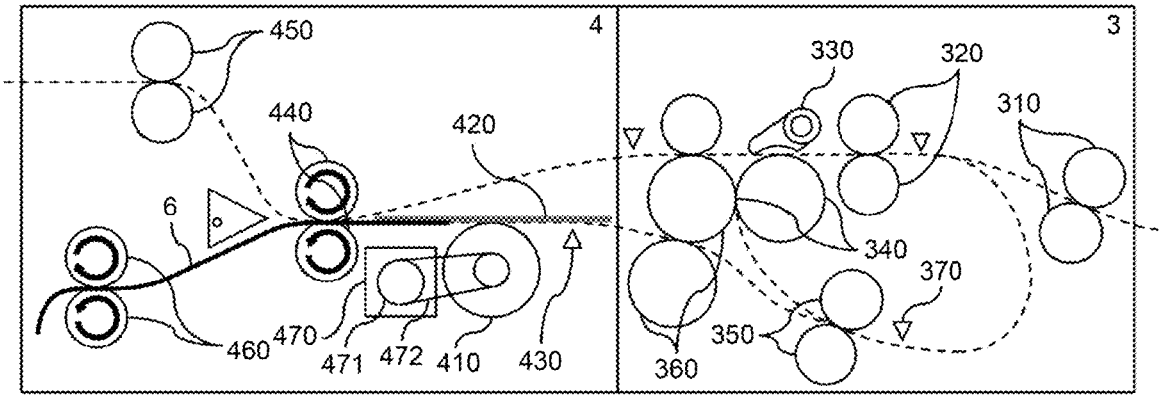

Meanwhile, as illustrated in FIG. 6C, if post-processing, such as stapling, punching, or bookbinding processing is performed on the sheet 6, which is conveyed through the gap between the fold-enhancing roller 410 and the sheet supporting plate 420 and on which a fold-enhancing operation has been performed, the fold-enhancing processing unit 4 uses the pair of fold-enhancing processing conveyance rollers 440 to convey the sheet 6 toward a pair of post-processing conveyance rollers 460. Then, the fold-enhancing processing unit 4 uses the pair of post-processing conveyance rollers 460 to convey, to an undepicted post-processing unit, the sheet 6 that is conveyed to the pair of post-processing conveyance rollers 460 by the pair of fold-enhancing processing conveyance rollers 440 and on which a fold-enhancing operation has been performed. Thus, a folding processing operation and a fold-enhancing processing operation by the image forming apparatus 1 according to the present embodiment are completed.

Next, examples of the structure of the fold-enhancing roller 410 according to the present embodiment are explained with reference to FIGS. 8 to 11 and FIGS. 12 to 15.

Figure 8:
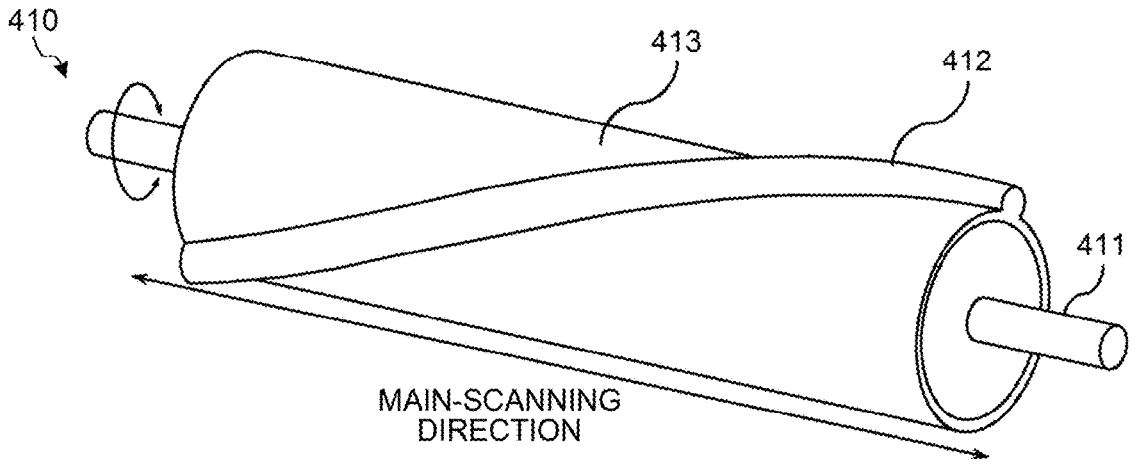
FIG. 8 is a perspective view that illustrates a fold-enhancing roller according to the embodiment of the present invention obliquely from the above and in a main-scanning direction.
Figure 9:
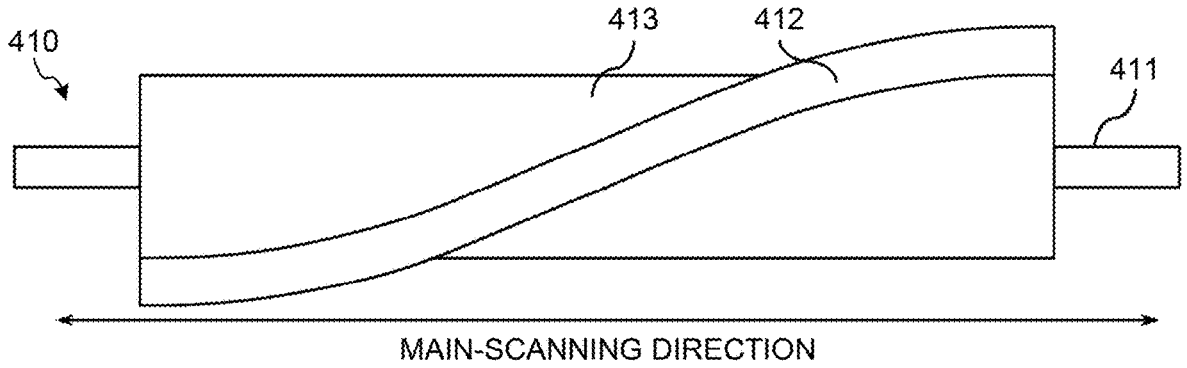
FIG. 9 is a front view that illustrates the fold-enhancing roller according to the embodiment of the present invention in a sub-scanning direction.
Figure 10:
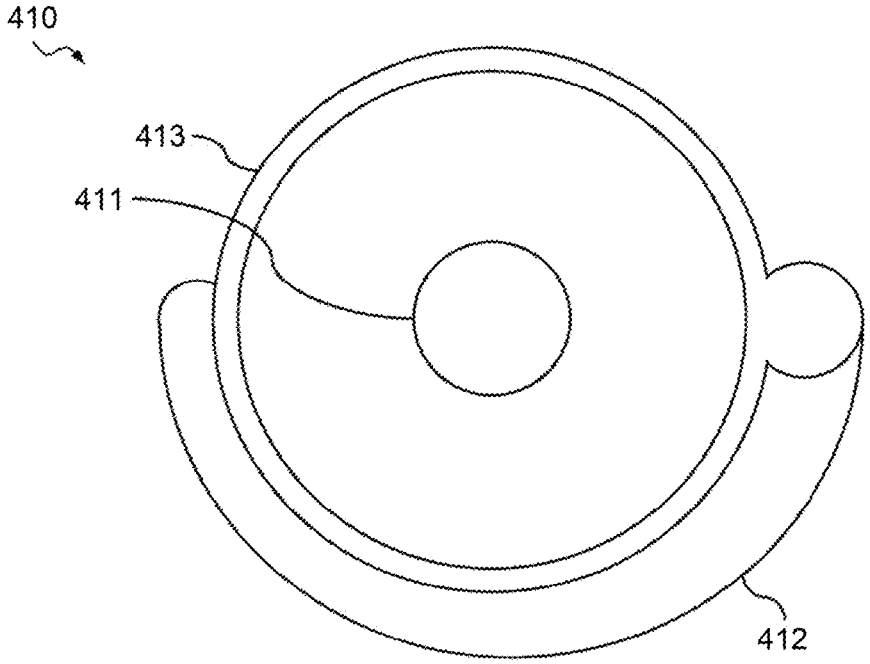
FIG. 10 is a side view that illustrates the fold-enhancing roller according to the embodiment of the present invention in a main-scanning direction.
Figure 11:
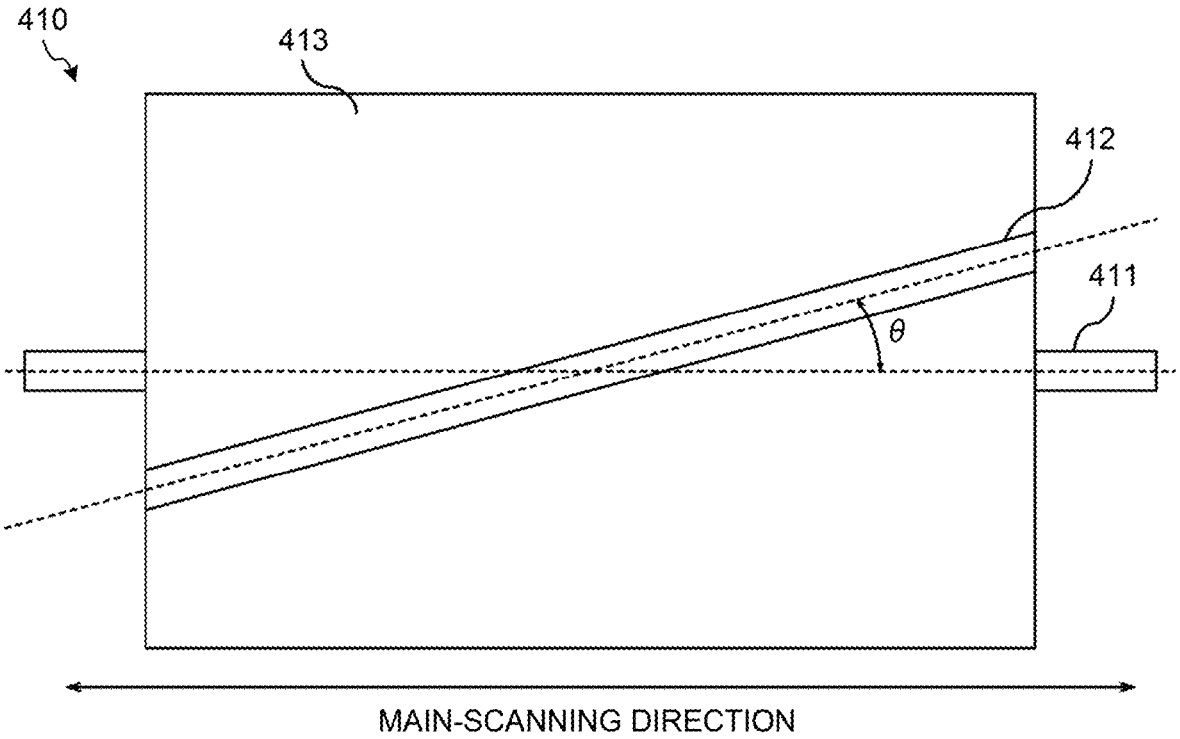
FIG. 11 is a development diagram of the fold-enhancing roller according to the embodiment of the present invention.

First, an explanation is given, with reference to FIGS. 8 to 11, of a first structure example of the fold-enhancing roller 410 according to the present embodiment. FIG. 8 is a perspective view that illustrates the fold-enhancing roller 410 according to the present embodiment obliquely from the above and in a main-scanning direction. FIG. 9 is a front view that illustrates the fold-enhancing roller 410 according to the present embodiment in a sub-scanning direction. FIG. 10 is a side view that illustrates the fold-enhancing roller 410 according to the present embodiment in a main-scanning direction. FIG. 11 is a development diagram of the fold-enhancing roller 410 according to the present embodiment.

As a first structure example illustrated in FIGS. 8 to 11, the fold-enhancing roller 410 according to the present embodiment is configured such that a protruding pressing-force transmission section 412 is arranged along the main-scanning direction in a helical fashion with a certain angle difference θ from the fold-enhancing roller rotary shaft 411 on the peripheral surface of a pressing-force transmission roller 413 that uses, as a rotary shaft, the fold-enhancing roller rotary shaft 411 that rotates about the axis that extends in the main-scanning direction. With the above configuration of the fold-enhancing roller 410 according to the present embodiment, only part of the pressing-force transmission section 412 is in contact with a fold line that is formed on the sheet 6.

Therefore, the fold-enhancing roller 410 according to the present embodiment rotates about the fold-enhancing roller rotary shaft 411 as a rotation axis, whereby a fold line formed on the sheet 6 can be sequentially pressed toward one direction along the main-scanning direction.

Therefore, the fold-enhancing processing unit 4 according to the present embodiment can applying an intensive pressing force to the entire area of a fold line for a short time. Thus, the image forming apparatus according to the present embodiment can reduce loads on the fold-enhancing roller rotary shaft 411 and apply a sufficient pressing force to a fold line without decreasing the productivity. Thus, the fold-enhancing processing unit 4 according to the present embodiment makes it possible to provide a fold-enhancing apparatus with a higher productivity, a reduced size, and low costs.

Figure 12:
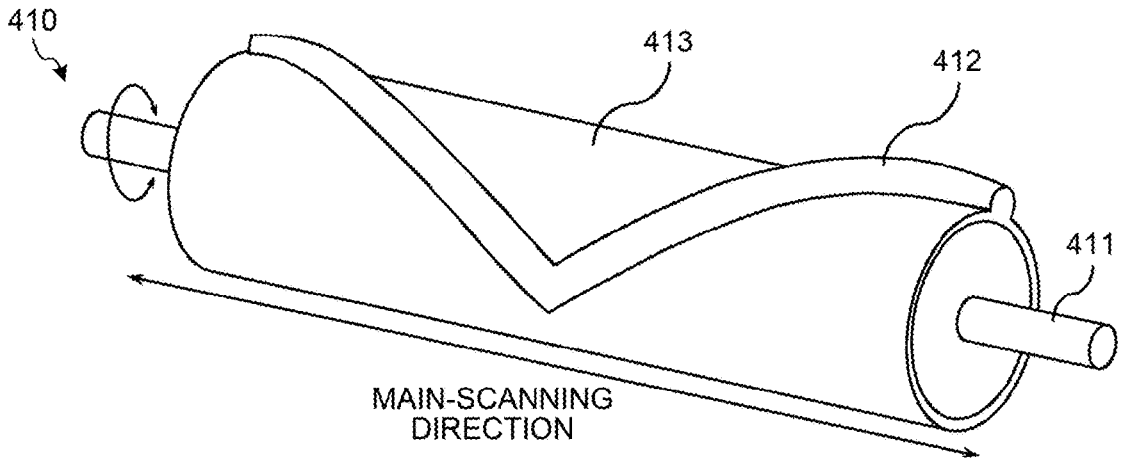
FIG. 12 is a perspective view that illustrates the fold-enhancing roller according to the embodiment of the present invention obliquely from the above and in a main-scanning direction.
Figure 13:
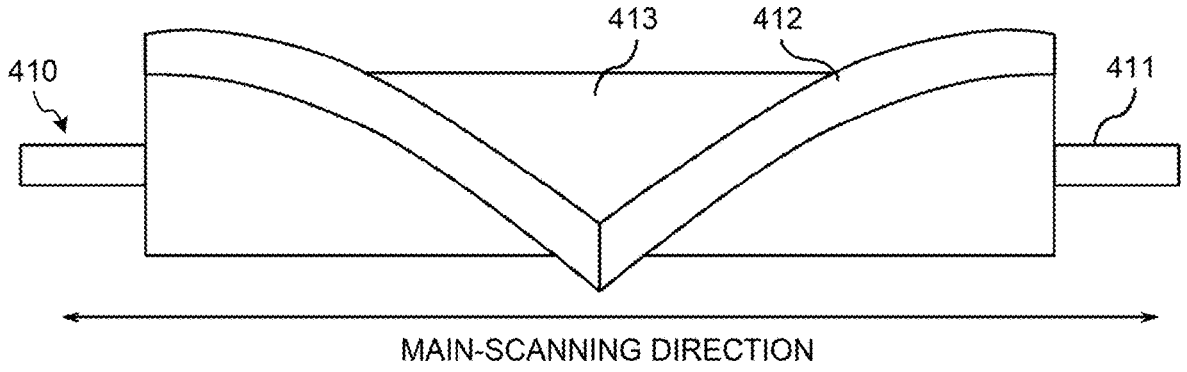
FIG. 13 is a front view that illustrates the fold-enhancing roller according to the embodiment of the present invention in a sub-scanning direction.
Figure 14:
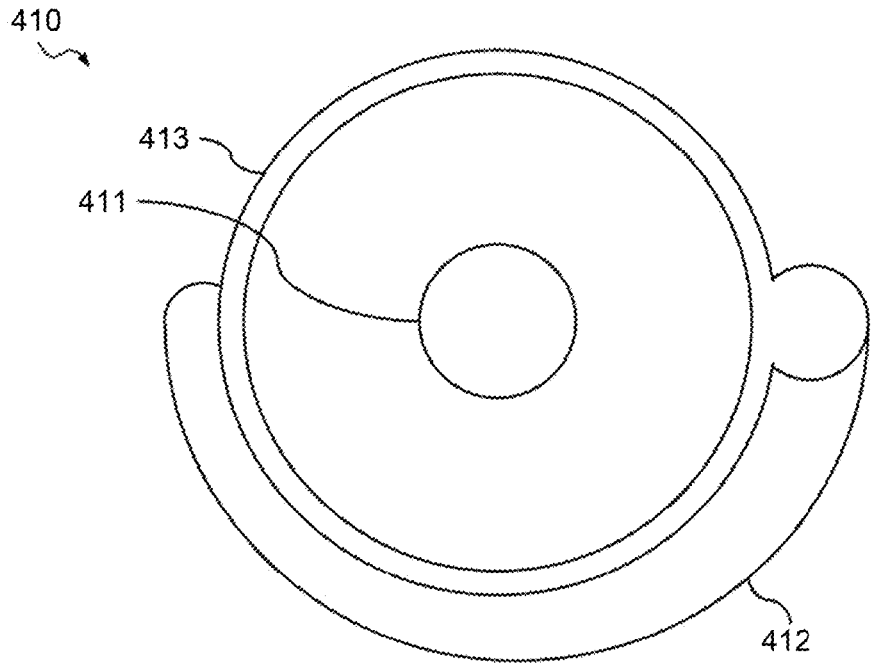
FIG. 14 is a side view that illustrates the fold-enhancing roller according to the embodiment of the present invention in a main-scanning direction.
Figure 15:
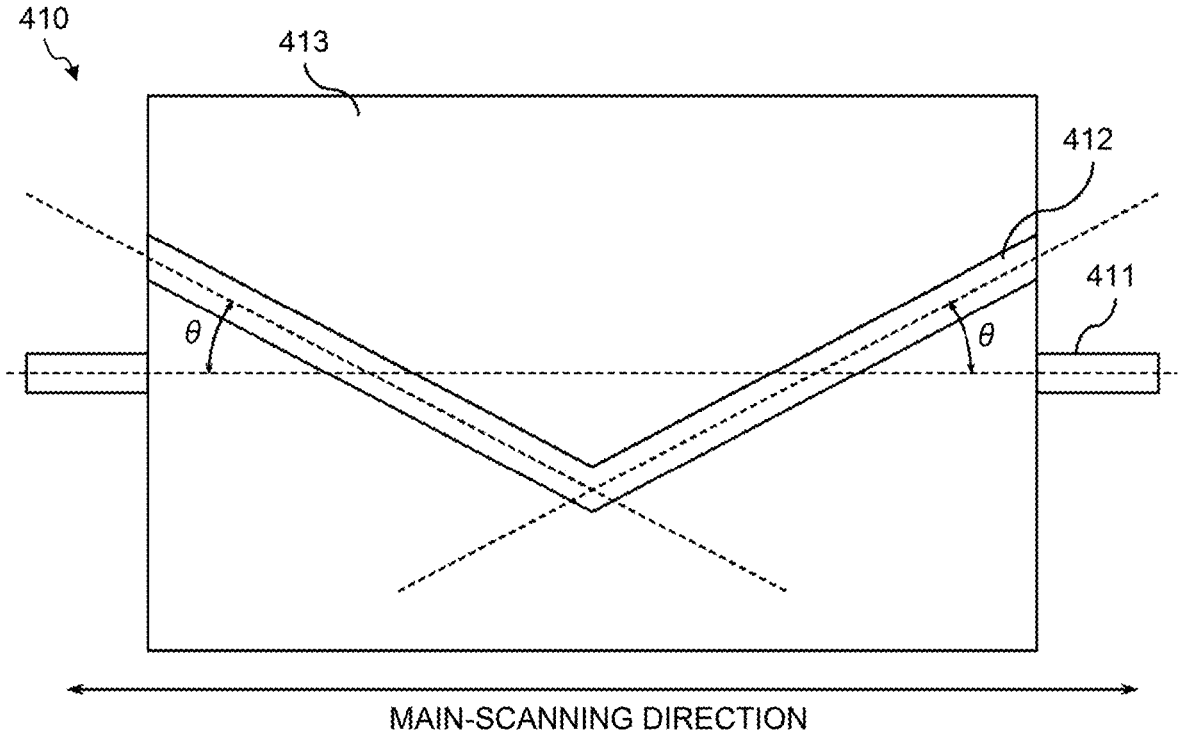
FIG. 15 is a development diagram of the fold-enhancing roller according to the embodiment of the present invention.

Next, an explanation is given, with reference to FIGS. 12 to 15, of a second structure example of the fold-enhancing roller 410 according to the present embodiment. FIG. 12 is a perspective view that illustrates the fold-enhancing roller 410 according to the present embodiment obliquely from the above and in a main-scanning direction. FIG. 13 is a front view that illustrates the fold-enhancing roller 410 according to the present embodiment in a sub-scanning direction. FIG. 14 is a side view that illustrates the fold-enhancing roller 410 according to the present embodiment in a main-scanning direction. FIG. 15 is a development diagram of the fold-enhancing roller 410 according to the present embodiment.

As a second structure example illustrated in FIGS. 12 to 15, the fold-enhancing roller 410 according to the present embodiment is configured such that the protruding pressing-force transmission section 412 is arranged in a helical fashion with the certain angle difference θ from the fold-enhancing roller rotary shaft 411 on the peripheral surface of the pressing-force transmission roller 413 and is arranged along a main-scanning direction in a V shape that is symmetrical about the center of the fold-enhancing roller 410 in a main-scanning direction. With the above configuration of the fold-enhancing roller 410 according to the present embodiment, two parts of the pressing-force transmission section 412 are simultaneously brought into contact with a fold line that is formed on the sheet 6.

Thus, the fold-enhancing roller 410 according to the present embodiment rotates about the fold-enhancing roller rotary shaft 411 that is a rotation axis, whereby a fold line formed on the sheet 6 is sequentially pressed toward both directions in a main-scanning direction.

With the fold-enhancing processing unit 4 according to the present embodiment, the pressing force is reduced compared to the structure that is illustrated in FIGS. 8 to 11; however, the intensive pressing force can be applied to the entire area of a fold line for a shorter time. Therefore, with the image forming apparatus according to the present embodiment, the productivity can be improved, the loads on the fold-enhancing roller rotary shaft 411 can be reduced, and a sufficient pressing force can be applied to a fold line. Thus, the fold-enhancing processing unit 4 according to the present embodiment makes it possible to provide a fold-enhancing apparatus with a higher productivity, a reduced size, and lower costs.

Figure 16:
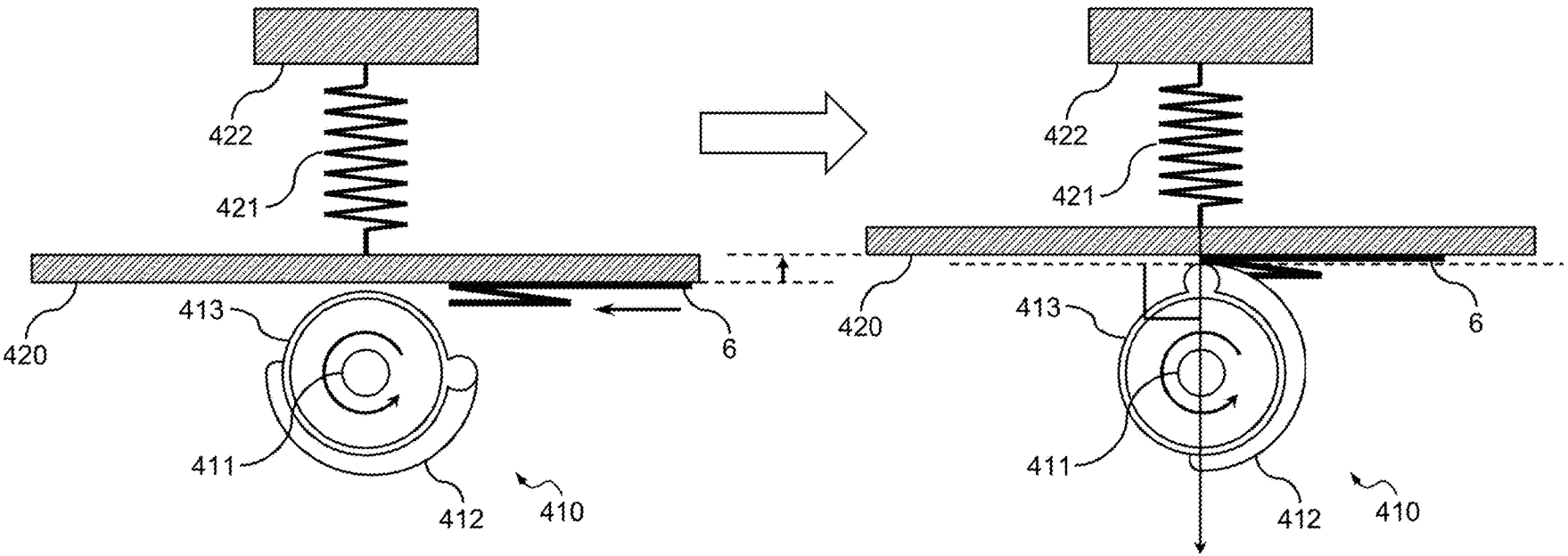
FIG. 16 is a side view that illustrates a sheet supporting plate according to the embodiment of the present invention in a main-scanning direction.
Figure 17:
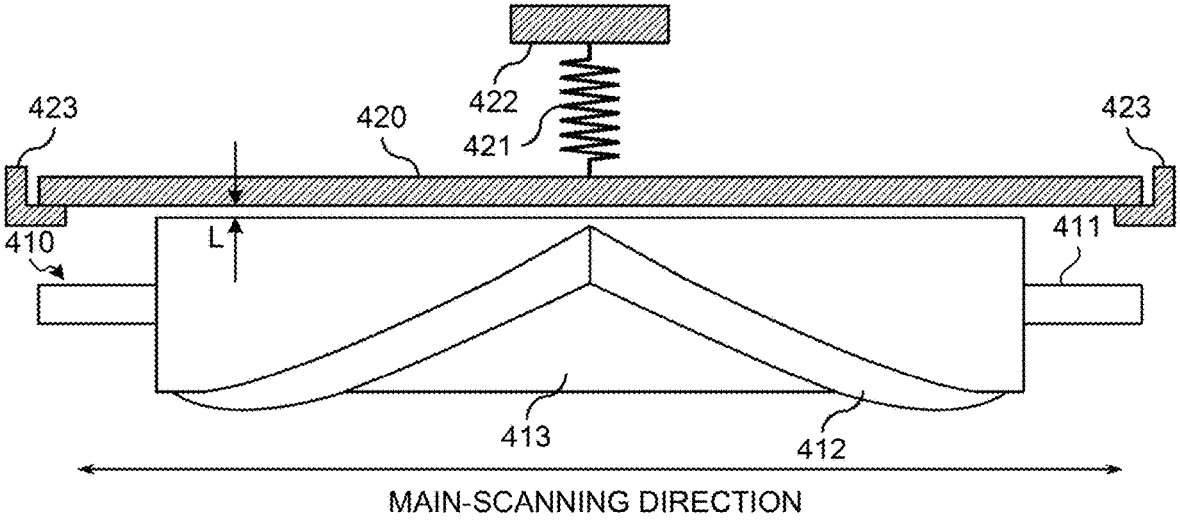
FIG. 17 is a front view that illustrates the sheet supporting plate according to the embodiment of the present invention during the normal time in a sub-scanning direction.
Figure 18:
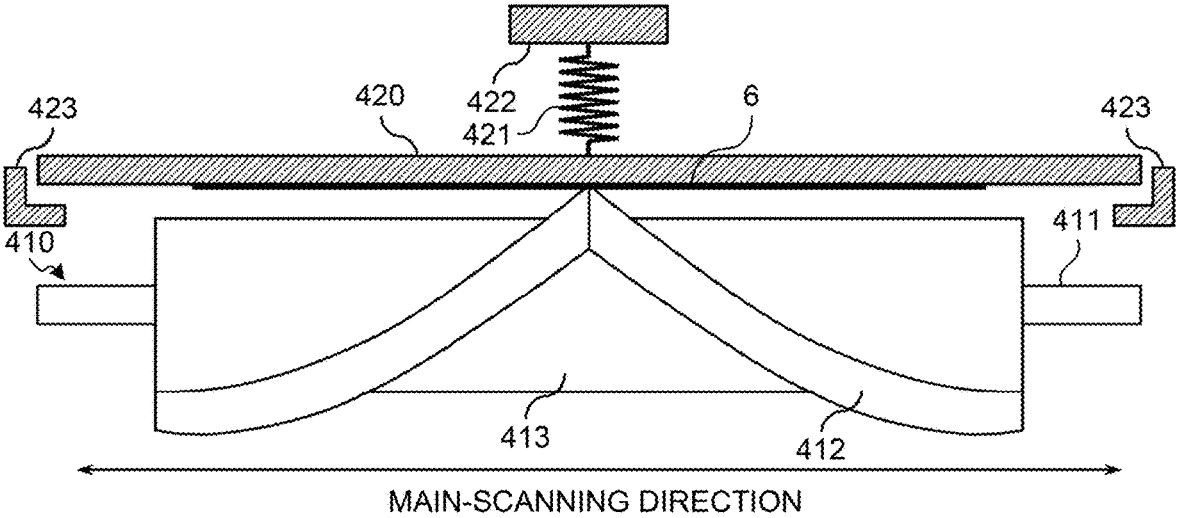
FIG. 18 is a front view that illustrates the sheet supporting plate according to the embodiment of the present invention during a fold-enhancing in the sub-scanning direction.

Next, an explanation is given, with reference to FIGS. 16 to 18, of a structure example of the sheet supporting plate 420 according to the present embodiment. FIG. 16 is a side view that illustrates the sheet supporting plate 420 according to the present embodiment in a main-scanning direction. FIG. 17 is a front view that illustrates the sheet supporting plate 420 according to the present embodiment during the normal time in a sub-scanning direction. FIG. 18 is a front view that illustrates the sheet supporting plate 420 according to the present embodiment during a fold-enhancing in the sub-scanning direction.

As illustrated in FIGS. 16 and 17, a force acts on the sheet supporting plate 420 according to the present embodiment during the normal time such that it is pressed against the fold-enhancing roller 410 due to the elastic force of an elastic body 421 that is compressed by the sheet supporting plate 420 and a fixing member 422; however, a restricting unit 423 puts a restriction to the sheet supporting plate 420 such that the gap with the pressing-force transmission roller 413 does not become less than a predetermined distance L. Furthermore, FIGS. 16 and 17 illustrate an example in which the elastic body 421 is made of a compressed spring; however, it may be made of other material that has elasticity, such as a plate spring, rubber, sponge, or plastic resin. That is, according to the present embodiment, the elastic body 421 serves as a pressing-force generating unit.

Furthermore, as illustrated in FIGS. 16 and 18, the sheet supporting plate 420 according to the present embodiment is pressed by the pressing-force transmission section 412 via the sheet 6 during a fold-enhancing so that the elastic body 421 is further moved in a compressing direction. Due to the elastic force of the elastic body 421 at that time, the fold-enhancing processing unit 4 according to the present embodiment presses a fold line that is formed on the sheet 6.

In the fold-enhancing processing unit 4 that is configured in this manner, it is one feature of the present embodiment that the elastic body 421 is located near the central part of the sheet supporting plate 420 in a main-scanning direction, as illustrated in FIGS. 16 to 18.

Figure 19:
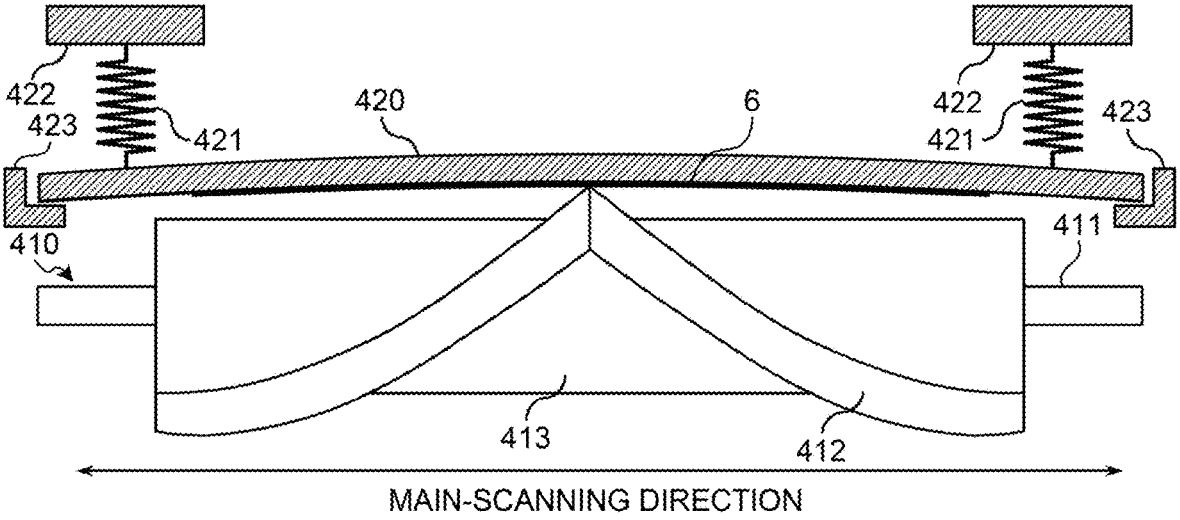
FIG. 19 is a front view that illustrates a conventional sheet supporting plate during a fold-enhancing in a sub-scanning direction.

Therefore, unlike the case of a configuration in which the elastic bodies 421 are located near both ends of the sheet supporting plate 420 in a main-scanning direction as illustrated in FIG. 19, the fold-enhancing processing unit 4 according to the present embodiment can prevent the occurrence of a moment in the direction that is opposite to the pressing direction near the central part of the sheet supporting plate 420 in a main-scanning direction.

FIG. 19 is a front view that illustrates the conventional sheet supporting plate 420 during a fold-enhancing in a sub-scanning direction. As illustrated in FIG. 19, the conventional fold-enhancing processing unit 4 needs to be configured such that the elastic bodies 421 are located near both ends of the sheet supporting plate 420 in a main-scanning direction due to the limitations of the apparatus. Therefore, as illustrated in FIG. 19, the conventional fold-enhancing processing unit 4 has a problem in that a moment occurs in the direction opposite to the pressing direction near the central part of the sheet supporting plate 420 in a main-scanning direction, the sheet supporting plate 420 is bent due to the moment that occurs near the above-described central part, and a sufficient pressing force cannot be generated near the central part.

As illustrated in FIGS. 16 to 18, the fold-enhancing processing unit 4 according to the present embodiment has one feature that the elastic body 421 is located near the central part of the sheet supporting plate 420 in the main-scanning direction. Therefore, with the fold-enhancing processing unit 4 according to the present embodiment, it is possible to prevent the occurrence of moments in the direction opposite to the pressing direction near the central part of the sheet supporting plate 420 in a main-scanning direction, and it is possible to prevent the situation where the sheet supporting plate 420 is bent due to the moment that occurs near the central part and a sufficient pressing force cannot be generated near the above-described central part.

Thus, the fold-enhancing processing unit 4 according to the present embodiment can uniformly generate a pressing force over the entire area in a main-scanning direction. Therefore, with the fold-enhancing processing unit 4 according to the present embodiment, it is possible to effectively enhance a fold line that is formed on the sheet 6.

Furthermore, as illustrated in FIG. 16, the elastic body 421 is provided in the fold-enhancing processing unit 4 according to the present embodiment such that, while the sheet 6 is pressed, the direction in which an elastic force acts is perpendicular to the direction of a tangent line at the contact point between the fold-enhancing roller 410 and the sheet 6. Therefore, the fold-enhancing processing unit 4 according to the present embodiment allows an elastic force of the elastic body 421 to efficiently act on a fold line that is formed on the sheet 6. Thus, the fold-enhancing processing unit 4 according to the present embodiment can generate a sufficient pressing force without increasing the elastic force of the elastic body 421 and, as a result, the loads on the fold-enhancing roller rotary shaft 411 can be reduced.

Here, particularly, as illustrated in FIG. 16, the elastic body 421 is provided in the fold-enhancing processing unit 4 according to the present embodiment such that, while the sheet 6 is pressed, the direction in which the elastic force acts passes through the contact point between the fold-enhancing roller 410 and the sheet 6. Therefore, the fold-enhancing processing unit 4 according to the present embodiment allows the elastic force of the elastic body 421 to more efficiently act on a fold line that is formed on the sheet 6. Thus, the fold-enhancing processing unit 4 according to the present embodiment can generate a sufficient pressing force without increasing the elastic force of the elastic body 421 and, as a result, the loads on the fold-enhancing roller rotary shaft 411 can be further reduced.

Furthermore, the predetermined distance L is about 2 mm, and the sheet supporting plate 420 according to the present embodiment stands by while maintain the gap of the predetermined distance L at times other than a fold-enhancing period. Therefore, in the fold-enhancing processing unit 4 according to the present embodiment, if paper jam, or the like, occurs during a fold-enhancing, it is possible to easily eliminate paper jam by placing the sheet supporting plate 420 and the fold-enhancing roller 410 in the state illustrated in FIGS. 16 and 17.

Figure 20A:
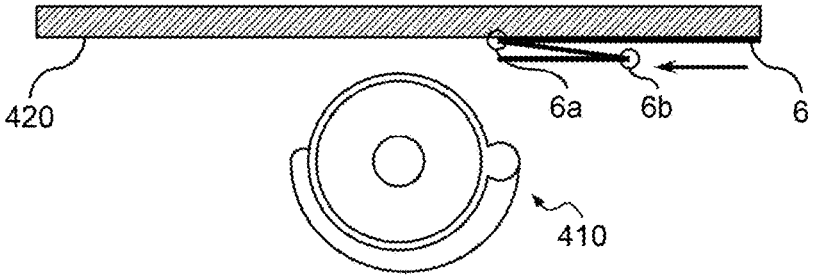
FIGS. 20A to 20F are cross-sectional views that illustrate the fold-enhancing roller and the sheet supporting plate in a main-scanning direction when the fold-enhancing processing unit according to the present embodiment performs a fold-enhancing operation.
Figure 20B:
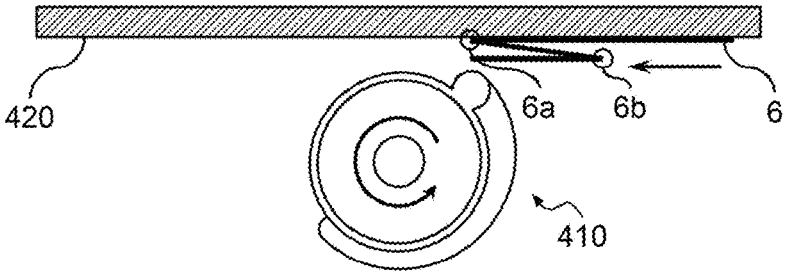
Figure 20C:
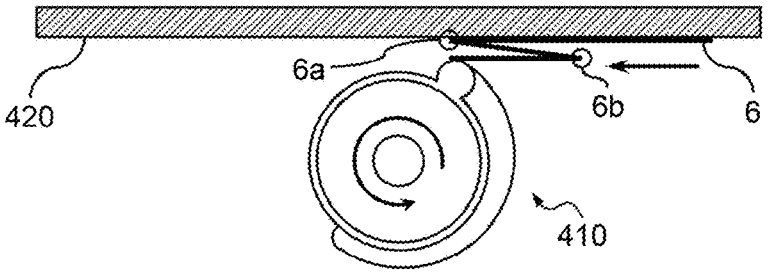
Figure 20D:
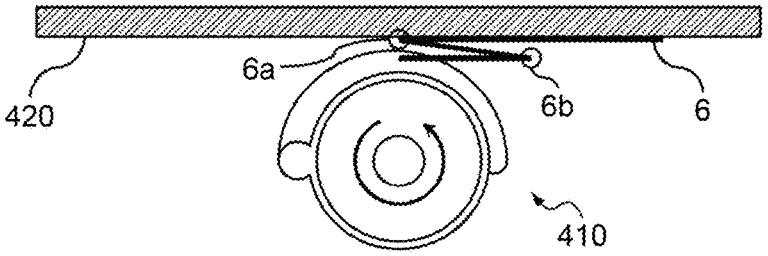
Figure 20E:
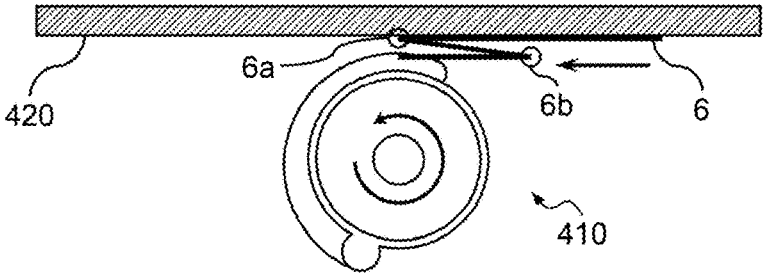
Figure 20F:
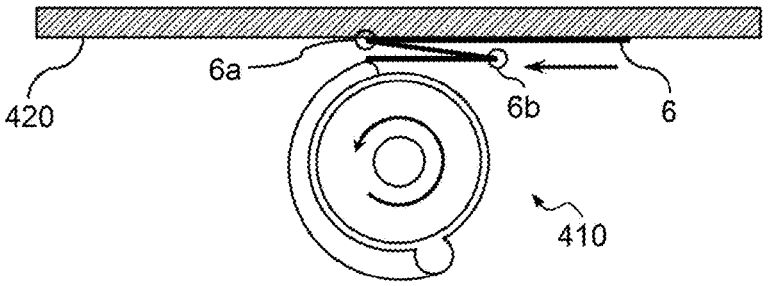
Figure 21A:
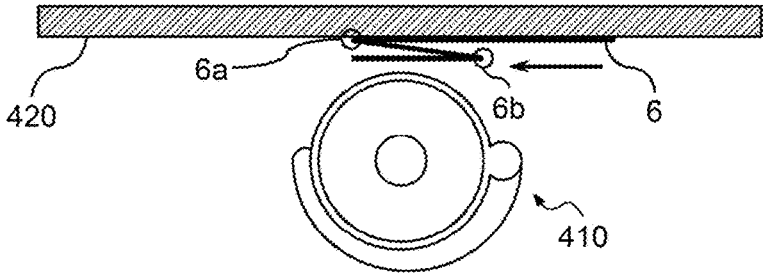
FIGS. 21A to 21F are cross-sectional views that illustrate the fold-enhancing roller and the sheet supporting plate in a main-scanning direction when the fold-enhancing processing unit according to the present embodiment performs a fold-enhancing operation.
Figure 21B:
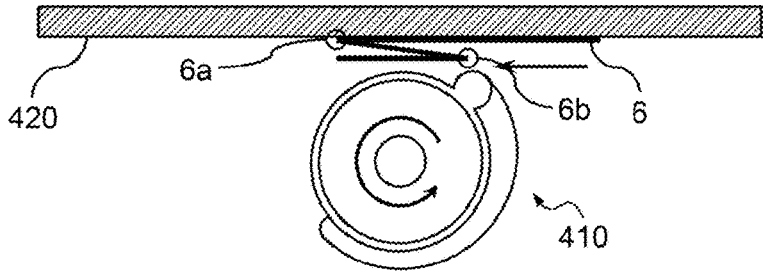
Figure 21C:
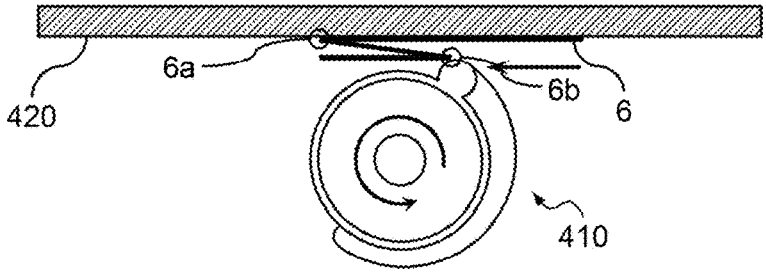
Figure 21D:
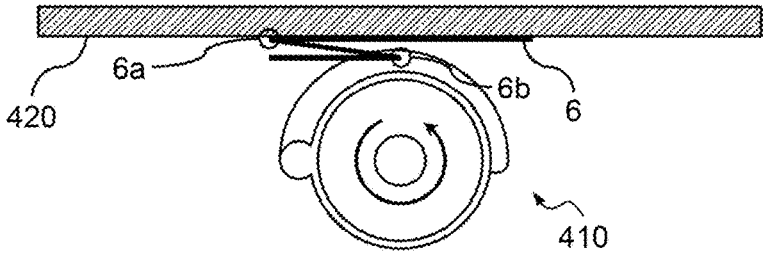
Figure 21E:
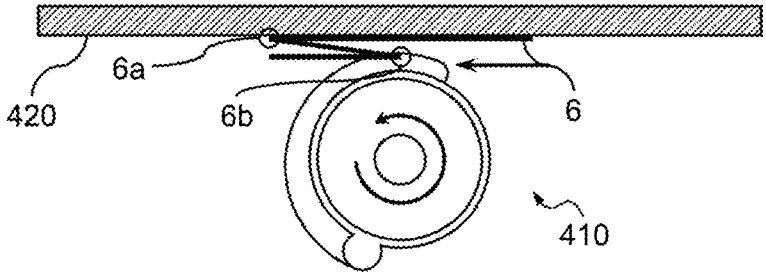
Figure 21F:
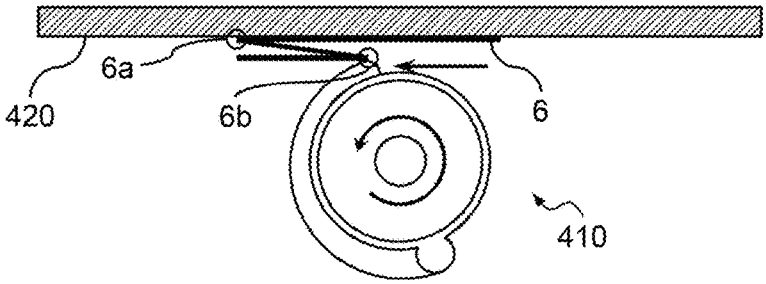
Figure 22:
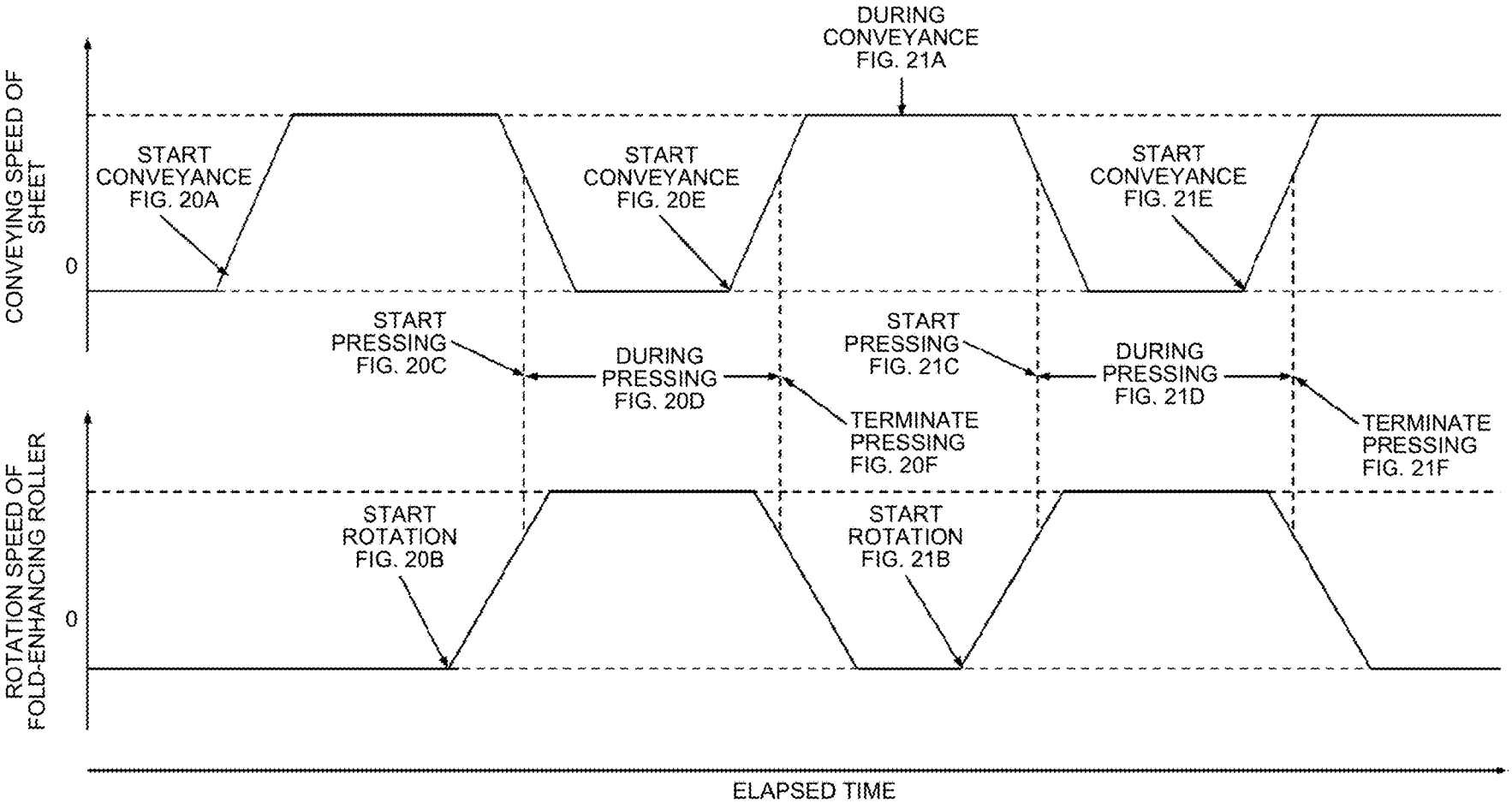
FIG. 22 is a diagram that illustrates the temporal changes of the conveying speed of the sheet and the rotating speed of the fold-enhancing roller when the fold-enhancing processing unit according to the present embodiment performs a fold-enhancing operation.

Next, an explanation is given, with reference to FIGS. 20A to 22, of the details of an operation example when the fold-enhancing processing unit 4 according to the present embodiment performs a fold-enhancing operation. FIGS. 20A to 21F are cross-sectional views that illustrate the fold-enhancing roller 410 and the sheet supporting plate 420 in a main-scanning direction when the fold-enhancing processing unit 4 according to the present embodiment performs a fold-enhancing operation. FIG. 22 is a diagram that illustrates the temporal changes of the conveying speed of the sheet 6 and the rotating speed of the fold-enhancing roller 410 when the fold-enhancing processing unit 4 according to the present embodiment performs a fold-enhancing operation. In FIGS. 20A to 22, an explanation is given of a case where a fold-enhancing operation is performed on the Z-fold sheet 6 that includes a first fold line 6*a* and a second fold line 6*b*. Incidentally, the operation of each operating units described below are performed under the control of the primary control unit 101 and the engine control unit 102.

After the fold-enhancing processing unit 4 according to the present embodiment starts to convey the sheet 6 as illustrated in FIG. 20A and FIG. 22, it calculates the timing until the fold-enhancing roller 410 is brought into contact with the first fold line 6*a* formed on the sheet 6 and then starts to rotate the fold-enhancing roller 410 without waiting for the sheet 6 to stop, as illustrated in FIG. 20B and FIG. 22. The reason why the fold-enhancing processing unit 4 according to the present embodiment starts to rotate the fold-enhancing roller 410 without waiting for the sheet 6 to stop as described above is to reduce the time lag from when the fold-enhancing roller 410 starts to rotate to when it is brought into contact with the sheet 6. Thus, the fold-enhancing processing unit 4 according to the present embodiment can improve the productivity.

Here, the fold-enhancing processing unit 4 uses the primary control unit 101 and the engine control unit 102 to control each unit on the basis of folding information on the type of folding that is performed by the folding processing unit 3, sheet information on the size of the sheet 6, the conveying speed of the sheet 6, and the rotating speed of the fold-enhancing roller 410 so as to calculate the timing until the fold-enhancing roller 410 is brought into contact with the first fold line 6*a* that is formed on the sheet 6. Alternatively, here, the fold-enhancing processing unit 4 uses the primary control unit 101 and the engine control unit 102 to control each unit on the basis of the conveying speed of the sheet 6, the rotating speed of the fold-enhancing roller 410, and sensor information that is input from the sensor 430 so as to calculates the timing until the fold-enhancing roller 410 is brought into contact with the first fold line 6*a* that is formed on the sheet 6.

Then, in the fold-enhancing processing unit 4, the fold-enhancing roller 410 starts to be in contact with the first fold line 6*a* that is formed on the sheet 6 so as to start to press the first fold line 6*a*, as illustrated in FIG. 20C and FIG. 22. In the fold-enhancing processing unit 4, as illustrated in FIGS. 20D and 22, the sheet 6 is conveyed until the above-described first fold line 6*a* is located right above the fold-enhancing roller rotary shaft 411, then the conveyance of the sheet 6 is completely stopped and the fold-enhancing roller 410 is continuously rotated, whereby the first fold line 6*a* formed on the sheet 6 is continuously pressed.

Afterward, as illustrated in FIG. 20E and FIG. 22, after calculating the timing until the fold-enhancing roller 410 separates from the sheet 6, the fold-enhancing processing unit 4 starts to convey the sheet 6 without waiting for the fold-enhancing roller 410 to stop. The reason why the fold-enhancing processing unit 4 according to the present embodiment starts to convey the sheet 6 without waiting for the fold-enhancing roller 410 to stop as described above is to reduce the time lag from when the fold-enhancing roller 410 separates from the sheet 6 to when it completely stops. Thus, the fold-enhancing processing unit 4 according to the present embodiment can improve the productivity.

Here, the fold-enhancing processing unit 4 uses the primary control unit 101 and the engine control unit 102 to control each unit on the basis of the rotating speed of the fold-enhancing roller 410 so as to calculate the timing until the fold-enhancing roller 410 separates from the sheet 6.

Furthermore, as illustrated in FIGS. 20E and 22, the sheet 6 can be started to be conveyed while it is pressed only when, in synchronization with the rotation of the fold-enhancing roller 410, the sheet 6 is conveyed by an undepicted conveyance belt that moves in the same direction as the rotation direction of the fold-enhancing roller 410. This is because, while the fold-enhancing roller 410 presses the sheet 6, the sheet 6 is pressed against the sheet supporting plate 420 and tear or the like may occur in the sheet 6 due to the friction with the sheet supporting plate 420 without the conveyance belt that moves in the same direction as the rotation direction of the fold-enhancing roller 410.

In the fold-enhancing processing unit 4, the sheet 6 is conveyed after it separates from the fold-enhancing roller 410 as illustrated in FIGS. 20F and 22, the rotation of the fold-enhancing roller 410 is stopped as illustrated in FIGS. 21A and 22 and, after the timing until the fold-enhancing roller 410 is brought into contact with the second fold line 6*b* formed on the sheet 6 is calculated, the rotation of the fold-enhancing roller 410 is started without waiting for the sheet 6 to stop as illustrated in FIG. 21B and FIG. 22. The reason why the fold-enhancing processing unit 4 according to the present embodiment starts to rotate the fold-enhancing roller 410 without waiting for the sheet 6 to stop as described above is to reduce the time lag from when the fold-enhancing roller 410 starts to rotate to when it is brought into contact with the sheet 6. Thus, the fold-enhancing processing unit 4 according to the present embodiment can improve the productivity.

Here, the fold-enhancing processing unit 4 uses the primary control unit 101 and the engine control unit 102 to control each unit on the basis of folding information on the type of folding that is performed by the folding processing unit 3, sheet information on the size of the sheet 6, the conveying speed of the sheet 6, and the rotating speed of the fold-enhancing roller 410 so as to calculate the timing until the fold-enhancing roller 410 is brought into contact with the second fold line 6*b* that is formed on the sheet 6. Alternatively, here, the fold-enhancing processing unit 4 uses the primary control unit 101 and the engine control unit 102 to control each unit on the basis of the conveying speed of the sheet 6, the rotating speed of the fold-enhancing roller 410, and sensor information that is input from the sensor 430 so as to calculate the timing until the fold-enhancing roller 410 is brought into contact with the second fold line 6*b* that is formed on the sheet 6.

Then, as illustrated in FIGS. 21C and 22, in the fold-enhancing processing unit 4, the fold-enhancing roller 410 starts to be in contact with the second fold line 6*b* formed on the sheet 6 so that it starts to press the second fold line 6*b*. In the fold-enhancing processing unit 4, as illustrated in FIGS. 21D and 22, the sheet 6 is conveyed until the above-described second fold line 6*b* is located right above the fold-enhancing roller rotary shaft 411, then the conveyance of the sheet 6 is completely stopped and the fold-enhancing roller 410 is continuously rotated, whereby the second fold line 6*b* formed on the sheet 6 is continuously pressed.

Afterward, as illustrated in FIGS. 21E and 22, the fold-enhancing processing unit 4 starts to convey the sheet 6 without waiting for the fold-enhancing roller 410 to stop after calculating the timing until the fold-enhancing roller 410 separates from the sheet 6. The reason why the fold-enhancing processing unit 4 according to the present embodiment starts to convey the sheet 6 without waiting for the fold-enhancing roller 410 to stop as described above is to reduce the time lag from when the fold-enhancing roller 410 separates from the sheet 6 to when it completely stops. Thus, the fold-enhancing processing unit 4 according to the present embodiment can improve the productivity.

Here, the fold-enhancing processing unit 4 uses the primary control unit 101 and the engine control unit 102 to control each unit on the basis of the rotating speed of the fold-enhancing roller 410 so as to calculate the timing until the fold-enhancing roller 410 separates from the sheet 6.

Furthermore, as illustrated in FIGS. 21E and 22, the sheet 6 can be started to be conveyed while it is pressed only when, in synchronization with the rotation of the fold-enhancing roller 410, the sheet 6 is conveyed by an undepicted conveyance belt that moves in the same direction as the rotation direction of the fold-enhancing roller 410. This is because, while the fold-enhancing roller 410 presses the sheet 6, the sheet 6 is pressed against the sheet supporting plate 420 and tear or the like may occur in the sheet 6 due to the friction with the sheet supporting plate 420 without the conveyance belt that moves in the same direction as the rotation direction of the fold-enhancing roller 410.

Then, as illustrated in FIGS. 21F and 22, the fold-enhancing processing unit 4 conveys the sheet 6 that separates from the fold-enhancing roller 410 so as to complete a fold-enhancing operation.

Figure 23:
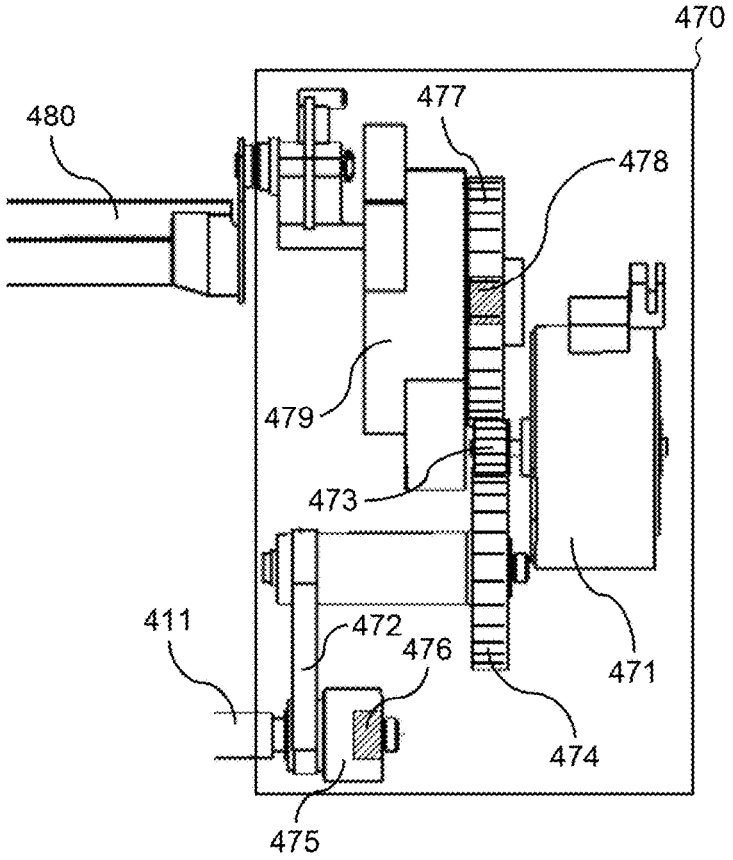
FIG. 23 is a diagram that illustrates a fold-enhancing roller drive device according to the present embodiment in a sub-scanning direction.
Figure 24:
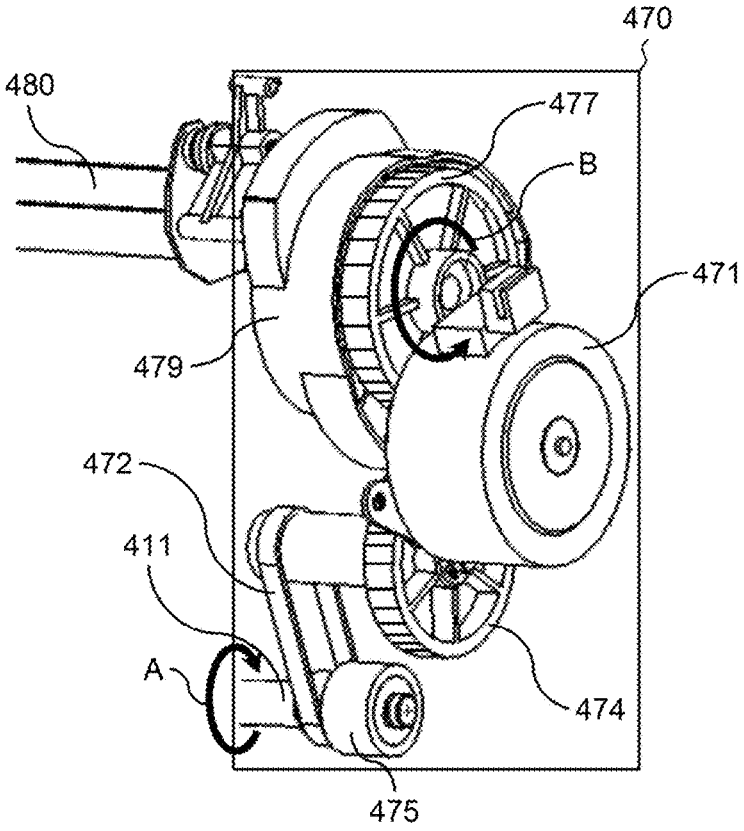
FIG. 24 is a perspective view of the fold-enhancing roller drive device according to the present embodiment.

Next, an explanation is given, with reference to FIGS. 23 and 24, of the structure of the fold-enhancing roller drive device 470 according to the present embodiment. FIG. 23 is a diagram that illustrates the fold-enhancing roller drive device 470 according to the present embodiment in a sub-scanning direction. FIG. 24 is a perspective view of the fold-enhancing roller drive device 470 according to the present embodiment.

As illustrated in FIGS. 23 and 24, the fold-enhancing roller drive device 470 according to the present embodiment is provided at one end of the fold-enhancing roller 410 in a main-scanning direction, and it includes the fold-enhancing roller drive motor 471, the timing belt 472, a reverse gear 473, a fold-enhancing roller rotary gear pulley 474, a fold-enhancing roller rotary pulley 475, a one-way clutch 476, a reverse rotation gear 477, a one-way clutch 478, and a reverse rotation cam 479.

The fold-enhancing roller drive motor 471 is a motor that rotates the reverse gear 473. The fold-enhancing roller rotary gear pulley 474 is a pulley that includes a gear that is engaged with the reverse gear 473, and it is rotated in the direction opposite to the rotation direction of the reverse gear 473 in accordance with the rotation of the reverse gear 473. The timing belt 472 is an endless belt for transmitting the rotation of the fold-enhancing roller rotary gear pulley 474 to the fold-enhancing roller rotary pulley 475. The fold-enhancing roller rotary pulley 475 is connected to the fold-enhancing roller rotary shaft 411, and it is rotated in the same direction as that of the fold-enhancing roller rotary gear pulley 474 by the timing belt 472 in accordance with the rotation of the fold-enhancing roller rotary gear pulley 474 so that the fold-enhancing roller rotary shaft 411 is rotated in the rotation direction.

In the fold-enhancing roller drive device 470 that is configured in this manner, if the fold-enhancing roller 410 is to be rotated in the direction of the arrow illustrated in FIG. 24, the fold-enhancing roller drive motor 471 is first rotated in the direction opposite to that of the arrow illustrated in FIG. 24 under the control of the engine control unit 102 so that the reverse gear 473 is rotated in the direction opposite to the direction of the arrow illustrated in FIG. 24. Thus, the fold-enhancing roller rotary gear pulley 474 is rotated in the same direction as that of the arrow illustrated in FIG. 24, and the rotation is transmitted to the fold-enhancing roller rotary pulley 475 via the timing belt 472.

Then, when the fold-enhancing roller rotary pulley 475 is rotated, the fold-enhancing roller rotary shaft 411 is rotated in conjunction with the rotation so that the fold-enhancing roller 410 is rotated in the direction of the arrow illustrated in FIG. 24. Furthermore, if the fold-enhancing roller drive device 470 rotates the fold-enhancing roller 410 in the direction opposite to that of the arrow illustrated in FIG. 24, each is rotated in the direction opposite to the above-described one.

The one-way clutch 476 is provided inside the fold-enhancing roller rotary pulley 475, and it is configured to, only when the fold-enhancing roller rotary pulley 475 is rotated in a specific direction, rotate the fold-enhancing roller rotary shaft 411 in the same direction and, if the fold-enhancing roller rotary pulley 475 is rotated in the direction opposite to the above-described specific direction, it idles so as to prevent the fold-enhancing roller rotary shaft 411 from rotating.

Furthermore, the one-way clutch 476 according to the present embodiment is configured to, only when the fold-enhancing roller rotary pulley 475 is rotated in the direction of the arrow A illustrated in FIG. 24, rotate the fold-enhancing roller rotary shaft 411 in the same direction and it is configured to idle when the fold-enhancing roller rotary pulley 475 is rotated in the direction opposite to the direction of the arrow A illustrated in FIG. 24.

The reverse rotation gear 477 is the gear that is engaged with the reverse gear 473, and it is rotated in the direction opposite to the rotation direction of the reverse gear 473, i.e., in the same direction as that of the fold-enhancing roller rotary gear pulley 474, in accordance with the rotation of the reverse gear 473. The one-way clutch 478 is provided inside the reverse rotation gear 477, and it is configured to, as is the case with the one-way clutch 476, only when the reverse rotation gear 477 is rotated in a specific direction, rotate the reverse rotation cam 479 in the same direction and, when the reverse rotation gear 477 is rotated in the direction opposite to the above-described specific direction, it idles so as to prevent the reverse rotation cam 479 from rotating.

Furthermore, the one-way clutch 478 according to the present embodiment is configured to, only when the reverse rotation gear 477 is rotated in the direction of the arrow B illustrated in FIG. 24, rotate the reverse rotation cam 479 in the same direction and it is configured to idle when the reverse rotation gear 477 is rotated in the direction opposite to the direction of the arrow B illustrated in FIG. 24.

With the above-described configurations of the one-way clutch 476 and the one-way clutch 478, if the fold-enhancing roller drive motor 471 is rotated, only any one of the fold-enhancing roller rotary pulley 475 and the reverse rotation cam 479 is rotated. Furthermore, the rotation directions of the fold-enhancing roller rotary pulley 475 and the reverse rotation cam 479 are opposite to each other.

The reverse rotation cam 479 has a curved surface whose distance from the rotation axis of the reverse rotation gear 477 is not constant, and the part of the curved surface with the long distance from the rotation axis of the reverse rotation gear 477 is connected to a reverse-rotation drive transmitting unit 480 that transmits the rotary movement of the reverse rotation cam 479 to a driving system other than the fold-enhancing roller 410.

If the fold-enhancing roller drive device 470 that is configured in this manner rotates the fold-enhancing roller 410 in the direction of the arrow A illustrated in FIG. 24, the fold-enhancing roller drive motor 471 is first rotated in the direction opposite to that of the arrow A illustrated in FIG. 24 under the control of the engine control unit 102 so that the reverse gear 473 is rotated in the direction opposite to the direction of the arrow A illustrated in FIG. 24. Thus, the fold-enhancing roller rotary gear pulley 474 is rotated in the same direction as that of the arrow A illustrated in FIG. 24, and the rotation is transmitted to the fold-enhancing roller rotary pulley 475 via the timing belt 472.

Then, when the fold-enhancing roller rotary pulley 475 is rotated, the fold-enhancing roller rotary shaft 411 is rotated in conjunction with the above rotation so that the fold-enhancing roller 410 is rotated in the direction illustrated in FIG. 24. Here, due to the function of the one-way clutch 478, the reverse rotation gear 477 is not rotated.

Furthermore, in the fold-enhancing roller drive device 470 that is configured in this manner, to use the driving force of the fold-enhancing roller drive motor 471 for another driving system, the fold-enhancing roller drive motor 471 is first rotated in the direction opposite to that of the arrow B illustrated in FIG. 24 under the control of the engine control unit 102 so that the reverse rotation gear 477 is rotated in the direction opposite to the direction of the arrow B illustrated in FIG. 24.

Thus, the reverse rotation cam 479 is rotated in the same direction as that of the arrow B illustrated in FIG. 24 to transmit the rotary movement to a driving system other than the fold-enhancing roller 410 via the reverse-rotation drive transmitting unit 480. Here, due to the function of the one-way clutch 476, the fold-enhancing roller rotary pulley 475 is not rotated.

With the above configuration, the fold-enhancing processing unit 4 according to the present embodiment can use, for another driving system, the driving force of the fold-enhancing roller drive motor 471 for rotating the fold-enhancing roller 410 in the direction opposite to the rotatable direction.

Furthermore, with the above configuration of the fold-enhancing roller drive device 470, when the fold-enhancing processing unit 4 is to stop rotating the fold-enhancing roller 410, it first stops rotating the fold-enhancing roller drive motor 471; however, because of the function of the one-way clutch 476, the fold-enhancing roller 410 continues rotating in the same direction for a while due to the rotation moment caused by its own inertia force. This is because, even if the rotation of the fold-enhancing roller drive motor 471 is stopped, the rotation moment due to the inertia force cannot be canceled from the direction opposite to the rotation direction of the fold-enhancing roller 410 due to the function of the one-way clutch 476.

Therefore, in the fold-enhancing processing unit 4 according to the present embodiment, even if it is intended to rotate the fold-enhancing roller 410 by the predetermined angle θ and stop it at the rotation angle θ, the fold-enhancing roller 410 is actually stopped after rotating by more than the predetermined angle θ; therefore, the accurate rotation angle of the fold-enhancing roller 410 is undetermined.

Thus, if the fold-enhancing roller drive device 470 is configured in this manner, a stopping device is needed to accurately stop the fold-enhancing roller 410 at the above-described rotation angle θ after rotating it at the predetermined angle θ. Therefore, the fold-enhancing processing unit 4 according to the present embodiment includes a stopping device 490 that stops the fold-enhancing roller 410 at a predetermined position.

Figure 25:
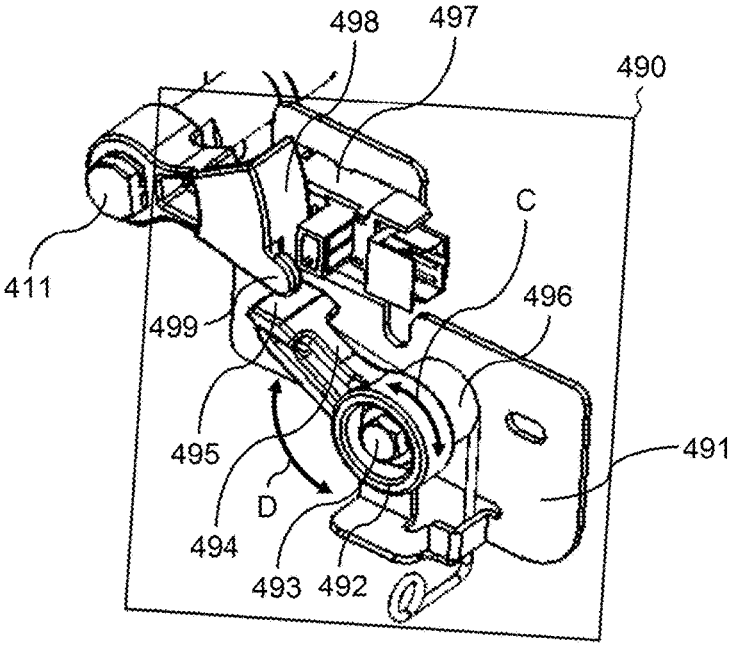
FIG. 25 is a perspective view of a stopping device according to the present embodiment.
Figure 26:
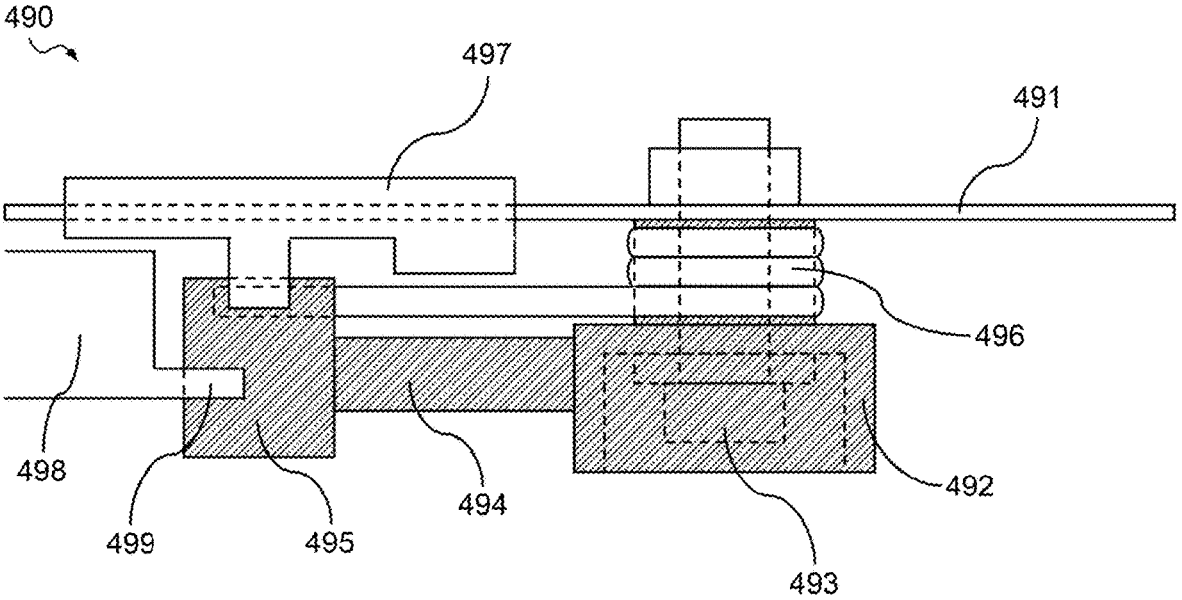
FIG. 26 is a transparent view that illustrates the stopping device according to the present embodiment in a direction perpendicular to the plane that is formed by a main-scanning direction and a sub-scanning direction.
Figure 27:
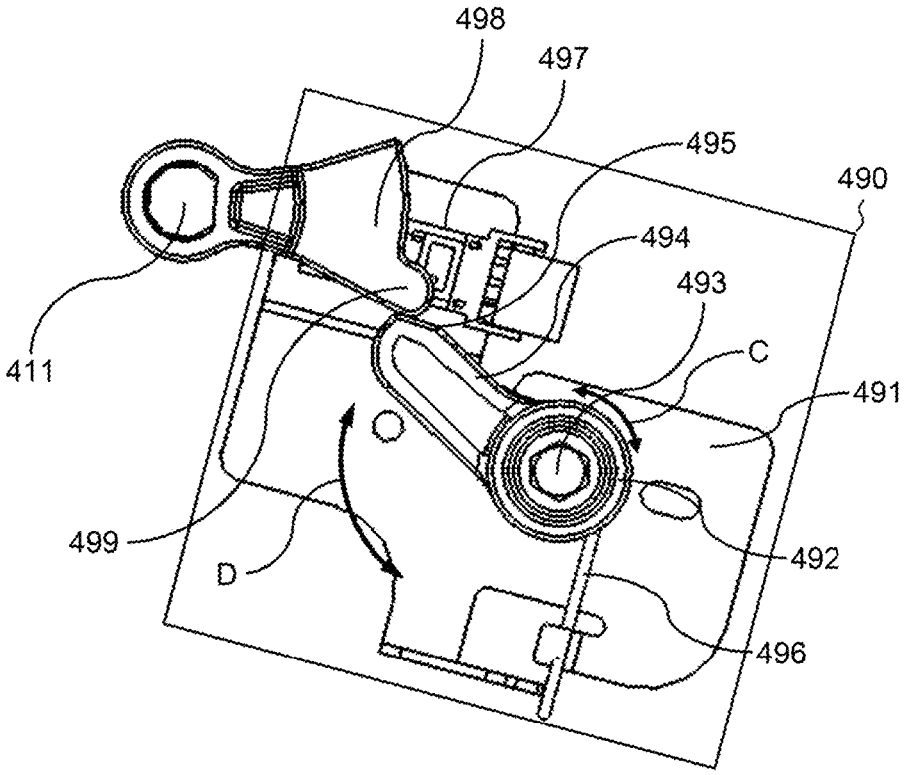
FIG. 27 is a diagram that illustrates the stopping device according to the present embodiment in a main-scanning direction.

Here, an explanation is given, with reference to FIGS. 25 to 27, of the structure of the stopping device 490 according to the present embodiment. FIG. 25 is a perspective view of the stopping device 490 according to the present embodiment. FIG. 26 is a transparent view that illustrates the stopping device 490 according to the present embodiment in a direction perpendicular to the plane that is formed by a main-scanning direction and a sub-scanning direction. FIG. 27 is a diagram that illustrates the stopping device 490 according to the present embodiment in a main-scanning direction.

As illustrated in FIGS. 25 to 27, the stopping device 490 according to the present embodiment is provided at the opposite side to the fold-enhancing roller drive device 470 in a main-scanning direction of the fold-enhancing roller 410, and it includes a stopping-device fixing section 491, a rotary section 492, a rotary screw 493, a connecting section 494, a rotation stopping section 495, a torsion spring 496, a sensor 497, a sensor shielding section 498, and a rotation-stop action section 499.

The stopping-device fixing section 491 is the fixing section that fixes the stopping device 490 to the fold-enhancing processing unit 4. The rotary section 492 is fixed to the stopping-device fixing section 491 with the rotary screw 493 such that it is rotatable about the rotary screw 493 as a rotation axis in the direction of the arrow C illustrated in FIGS. 25 and 27. The rotary screw 493 fixes the rotary section 492 to the stopping-device fixing section 491 such that the rotary screw 493 is the rotation axis of the rotary section 492 and the rotary section 492 is rotatable in the direction of the arrow C illustrated in FIGS. 25 and 27. The connecting section 494 connects the rotary section 492 and the rotation stopping section 495. The rotation stopping section 495 is connected to the rotary section 492 via the connecting section 494 so that it is rotated about the rotary screw 493 as a rotation axis in the direction of the arrow D illustrated in FIGS. 25 and 27.

The torsion spring 496 is the torsion spring that is attached around the part where the rotary section 492 is fixed to the stopping-device fixing section 491 with the rotary screw 493, one end thereof is fixed to the stopping-device fixing section 491, and the other end thereof is fixed to the rotation stopping section 495. With this configuration, due to the elastic force of the torsion spring 496, a force acts to prevent the rotation of the rotation stopping section 495 about the rotary screw 493 as a rotation axis, whereby the rotation stopping section 495 can be returned to the original position. Furthermore, the elastic force of the torsion spring 496 according to the present embodiment is larger than the inertia force of the fold-enhancing roller 410.

The sensor 497 includes an infrared-ray emitting unit that emits infrared rays and an infrared-ray receiving unit that receives infrared rays and notifies the engine control unit 102 if infrared rays are emitted by the infrared-ray emitting unit toward the infrared-ray receiving unit and are blocked by the sensor shielding section 498. The sensor shielding section 498 is fixed to the fold-enhancing roller rotary shaft 411 and is rotated together with the fold-enhancing roller 410 and, when the fold-enhancing roller 410 is rotated by the predetermined angle θ, it blocks infrared rays that are emitted by the infrared-ray emitting unit toward the infrared-ray receiving unit in the sensor 497. With this configuration, in the fold-enhancing processing unit 4 according to the present embodiment, if the sensor shielding section 498 shields the sensor 497 as described above, it is possible to detect that the fold-enhancing roller 410 is rotated by the predetermined angle θ, and it is possible to perform a control so as to stop the fold-enhancing roller 410 at that time, i.e., a control so as to stop the rotation of the fold-enhancing roller drive motor 471.

The rotation-stop action section 499 is provided at an end of the sensor shielding section 498, and it is configured to be brought into contact with the rotation stopping section 495 when the fold-enhancing roller 410 is rotated by the above-described predetermined angle θ.

The fold-enhancing processing unit 4 according to the present embodiment includes the stopping device 490 that is configured in this manner; therefore, when the fold-enhancing roller 410 is rotated by the above-described predetermined angle θ and then the rotation of the fold-enhancing roller drive motor 471 is stopped so that the fold-enhancing roller 410 is stopped at the above rotation angle θ, the rotation moment due to the inertia force of the fold-enhancing roller 410 can be canceled from the opposite direction.

Thus, in the fold-enhancing processing unit 4 according to the present embodiment, even if the fold-enhancing roller drive device 470 is configured as illustrated in FIGS. 23 and 24, it is possible to prevent the fold-enhancing roller 410 from continuing rotating in the same direction for a while when it is intended to stop the rotation of the fold-enhancing roller drive motor 471 at the rotation angle θ after rotating the fold-enhancing roller 410 by the above-described predetermined angle θ.

Specifically, in the fold-enhancing processing unit 4 according to the present embodiment, it does not happen that the fold-enhancing roller 410 is actually stopped after being rotated by an angle greater than the above-described predetermined angle θ even if it is intended to rotate the fold-enhancing roller 410 by the predetermined angle θ and then stop it at the rotation angle θ. Thus, in the fold-enhancing processing unit 4 according to the present embodiment, even if the fold-enhancing roller drive device 470 is configured as illustrated in FIGS. 23 and 24, it is possible to rotate the fold-enhancing roller 410 by the above-described predetermined angle θ and accurately stop it at the rotation angle θ, and it is possible to always know the accurate rotation angle of the fold-enhancing roller 410.

As described above, the fold-enhancing processing unit 4 according to the present embodiment has on feature that it is configured such that the elastic body 421 is provided near the central part of the sheet supporting plate 420 in a main-scanning direction, as illustrated in FIGS. 16 to 18.

Therefore, unlike the case of the configuration such that the elastic bodies 421 are provided near both ends of the sheet supporting plate 420 in the main-scanning direction, as illustrated in FIG. 19, the fold-enhancing processing unit 4 according to the present embodiment can prevent the occurrence of moments in the direction opposite to the pressing direction near the central part of the sheet supporting plate 420 in a main-scanning direction.

Therefore, unlike the case illustrated in FIG. 19, the fold-enhancing processing unit 4 according to the present embodiment can prevent the situation where the sheet supporting plate 420 is bent due to the moment that occurs near the central part and a sufficient pressing force cannot be generated near the above-described central part.

Hence, the fold-enhancing processing unit 4 according to the present embodiment can uniformly generate a pressing force over the entire area in a main-scanning direction. Thus, with the fold-enhancing processing unit 4 according to the present embodiment, it is possible to effectively enhance a fold line that is formed on the sheet 6.

Figure 28A:
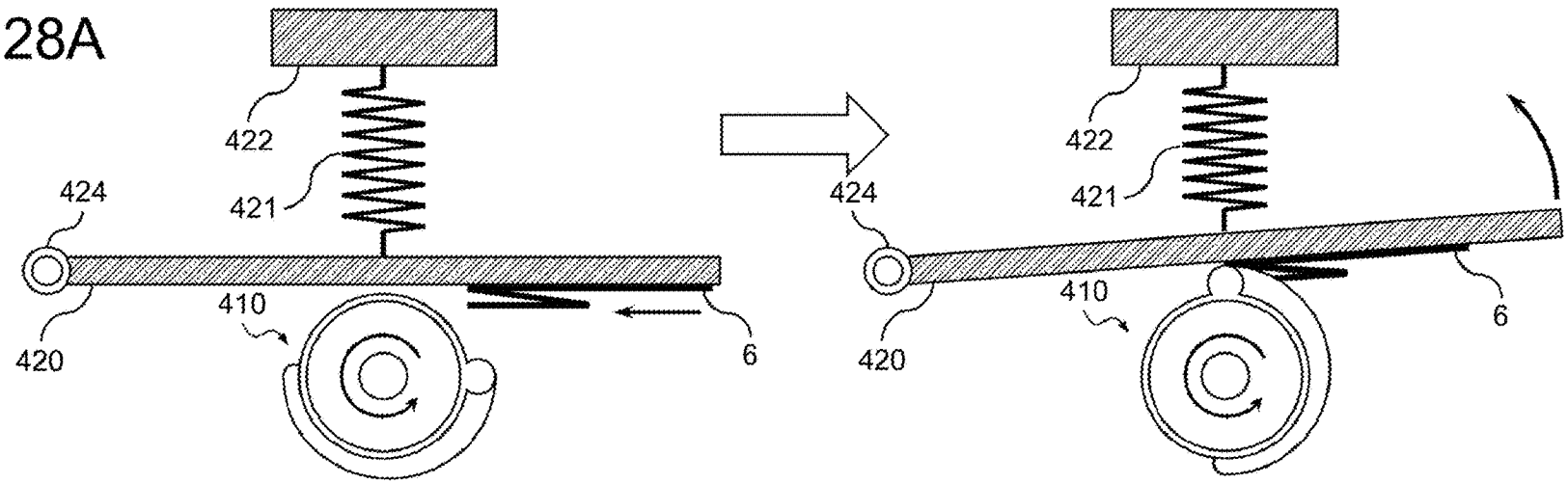
FIG. 28A is a side view that illustrates the sheet supporting plate according to the present embodiment in a main-scanning direction.
Figure 28B:
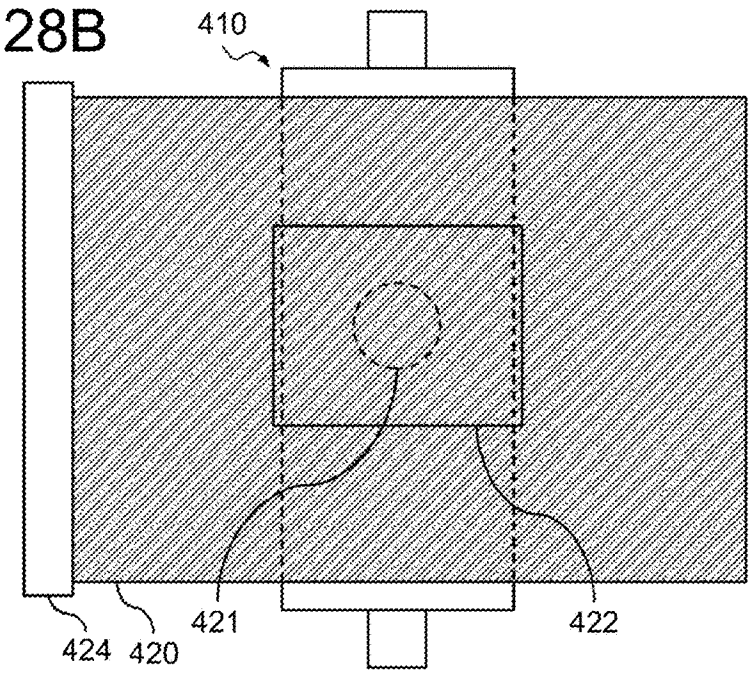
FIG. 28B is a transparent view that illustrates it in a pressing direction.

Although an explanation is given of a case where the sheet supporting plate 420 according to the present embodiment is configured as illustrated in FIGS. 16 to 18, it may be configured to swing in a pressing direction about a rotation supporting point 424 as a supporting point as illustrated in FIGS. 28A and 28B so that the horizontal of the sheet supporting plate 420 in a main-scanning direction is maintained with a higher accuracy. FIG. 28A is a side view that illustrates the sheet supporting plate 420 according to the present embodiment in a main-scanning direction, and FIG. 28B is a transparent view that illustrates it in a pressing direction. As the sheet supporting plate 420 according to the present embodiment is configured in this manner, it can be always kept parallel to the fold-enhancing roller 410 with a higher accuracy; therefore, a pressing force can be uniformly applied to the entire area of a fold line. In the example illustrated in FIGS. 28A and 28B, the rotation supporting point 424 is provided downstream in a conveying direction of the sheet 6; however, it may be provided upstream in the conveying direction.

Figure 29:
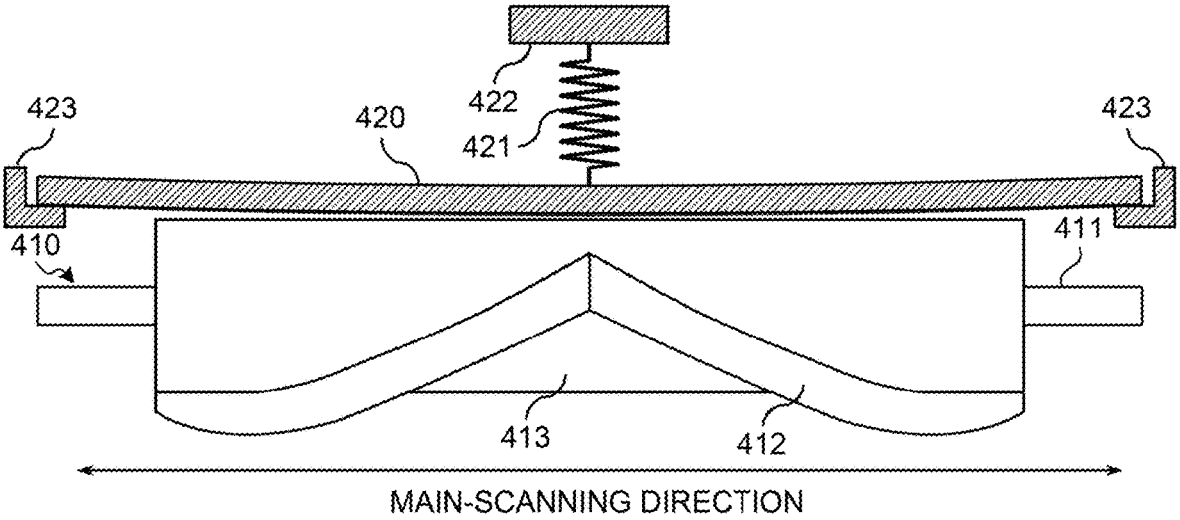
FIG. 29 is a front view that illustrates the sheet supporting plate according to the present embodiment during the normal time in a sub-scanning direction.

An explanation is given of a case where the sheet supporting plate 420 according to the present embodiment is configured as illustrated in FIGS. 16 to 18; however, if it is configured in this manner, moments occur toward the fold-enhancing roller 410 near the central part of the sheet supporting plate 420 in a main-scanning direction due to the elastic force of the elastic body 421 and the restricting unit 423 and therefore there is a possibility that the neighborhood of the central part is bent toward the fold-enhancing roller 410, as illustrated in FIG. 29. FIG. 29 is a front view that illustrates the sheet supporting plate 420 according to the present embodiment during the normal time in a sub-scanning direction. Therefore, if the time elapses in the above state, a plastic deformation occurs in the sheet supporting plate 420 according to the present embodiment.

Figure 30A:
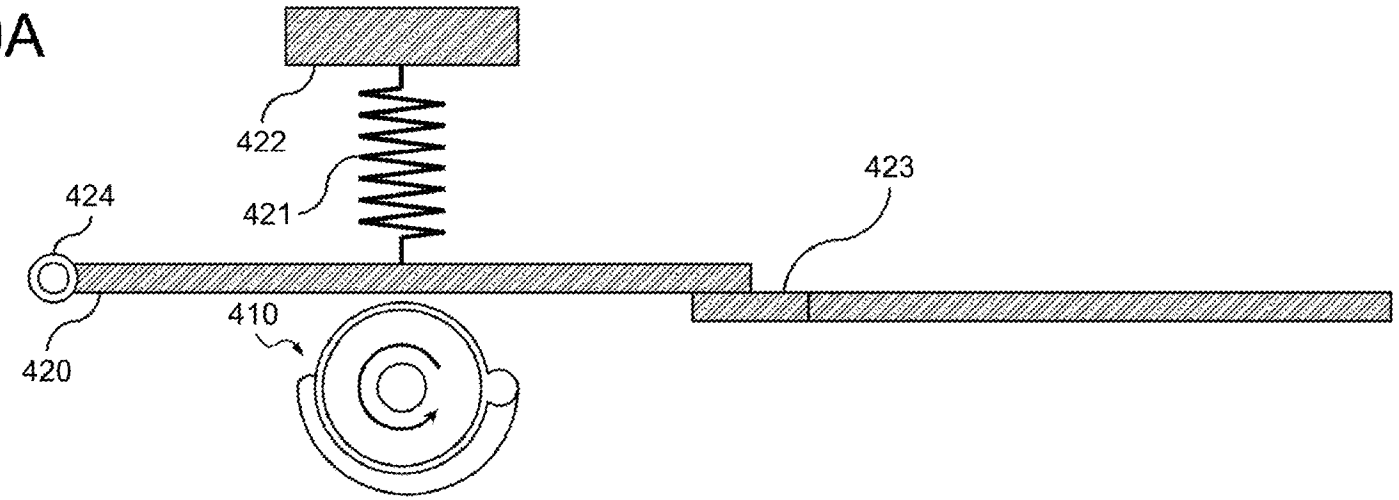
FIG. 30A is a side view that illustrates the sheet supporting plate according to the present embodiment in a main-scanning direction.
Figure 30B:
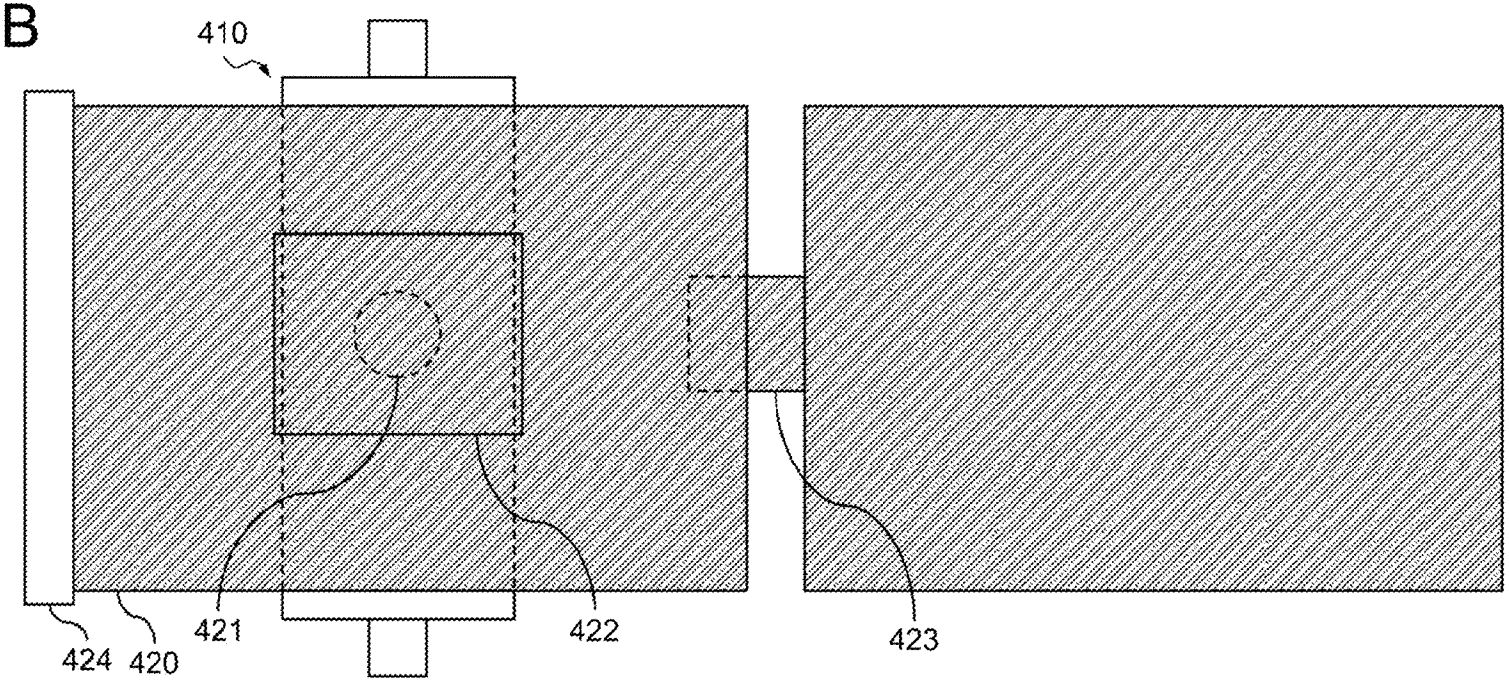
FIG. 30B is a transparent view that illustrates it in a pressing direction.

Hence, the sheet supporting plate 420 according to the present embodiment is configured such that the restricting unit 423 is provided not at both ends of the sheet supporting plate 420 in a main-scanning direction but at a location opposite to the rotation supporting point 424 in a sub-scanning direction and near the central part of the sheet supporting plate 420 in a main-scanning direction, as illustrated in FIGS. 30A and 30B; thus, it is possible to reduce the above-described moments that acts near the central part. FIG. 30A is a side view that illustrates the sheet supporting plate 420 according to the present embodiment in a main-scanning direction, and FIG. 30B is a transparent view that illustrates it in a pressing direction. Therefore, with the above configuration of the sheet supporting plate 420 according to the present embodiment, it is possible to prevent the above-described plastic deformation without increasing the stiffness.

Figure 31:
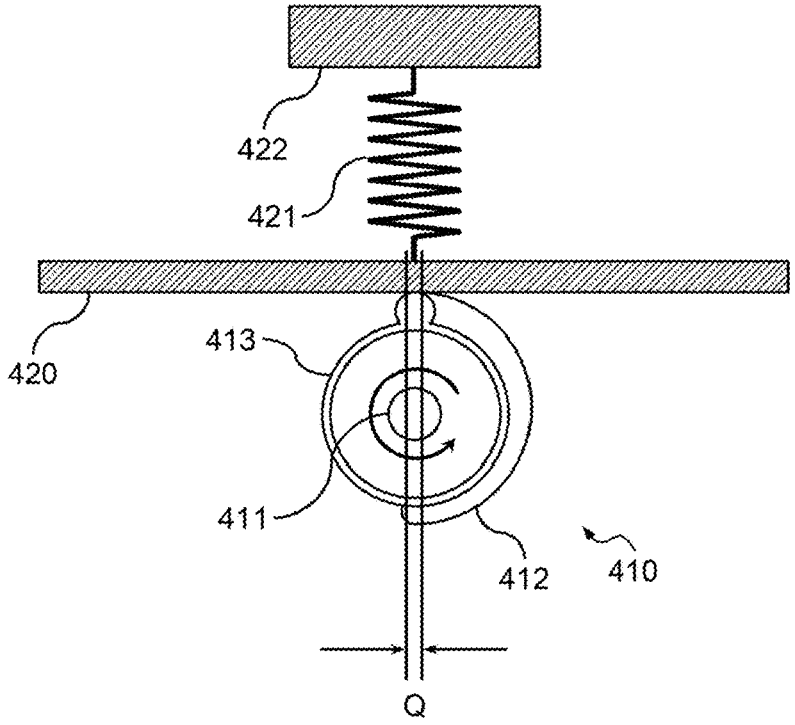
FIG. 31 is a side view that illustrates the sheet supporting plate according to the present embodiment in a main-scanning direction.

Although an explanation is given of a case where the sheet supporting plate 420 according to the present embodiment is configured as illustrated in FIG. 16, a contact width Q of the fold-enhancing roller 410 and the sheet supporting plate 420 is like a line contact, and they can be in contact in only a narrow area in the case of the above configuration as illustrated in FIG. 31; therefore, if the sheet 6 is slightly misaligned in a sheet conveying direction during a fold-enhancing, a fold line cannot be pressed. FIG. 31 is a side view that illustrates the sheet supporting plate 420 according to the present embodiment in a main-scanning direction.

Figure 32:
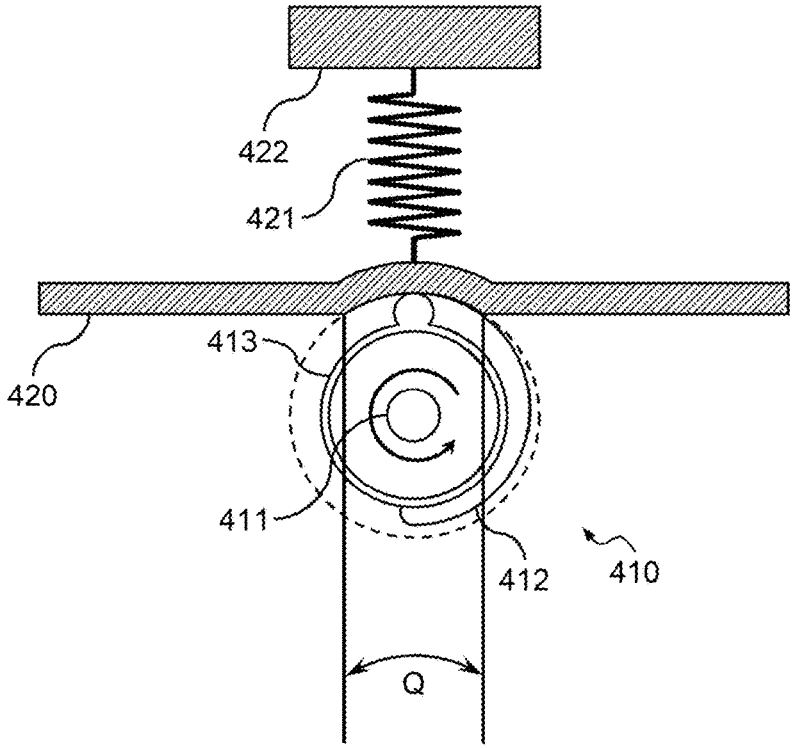
FIG. 32 is a side view that illustrates the sheet supporting plate according to the present embodiment in a main-scanning direction.

Therefore, the sheet supporting plate 420 according to the present embodiment is configured to have an arc shape corresponding to the trajectory that is formed by the outer diameter of the pressing-force transmission section 412 in accordance with the rotation of the pressing-force transmission section 412, as illustrated in FIG. 32; thus, the contact width Q of the fold-enhancing roller 410 and the sheet supporting plate 420 can be increased. FIG. 32 is a side view that illustrates the sheet supporting plate 420 according to the present embodiment in a main-scanning direction. Therefore, with the above configuration of the sheet supporting plate 420 according to the present embodiment, even if the sheet 6 is misaligned in a sheet conveying direction during a fold-enhancing, a fold line can be pressed.

Figure 33:
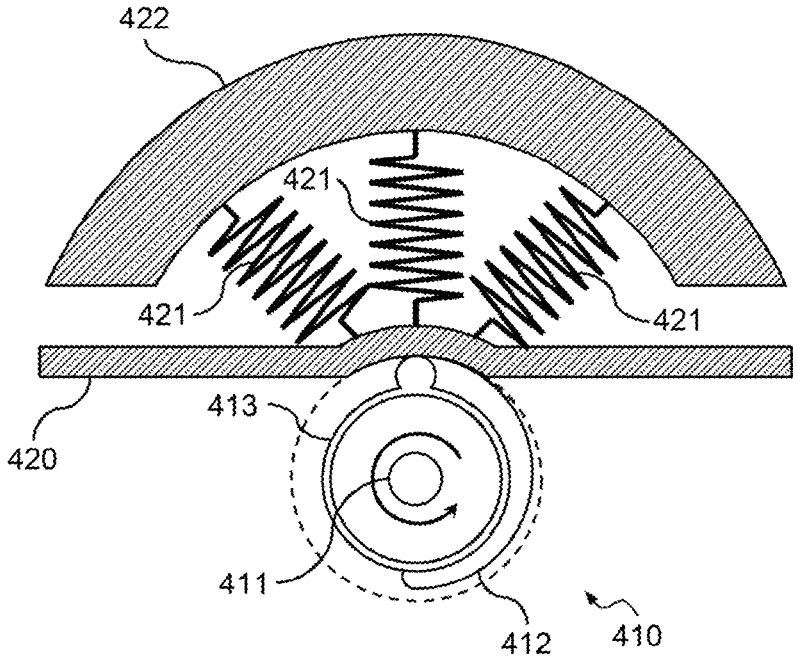
FIG. 33 is a side view that illustrates the sheet supporting plate according to the present embodiment in a main-scanning direction.

Furthermore, if the sheet supporting plate 420 according to the present embodiment is configured as illustrated in FIG. 32, the multiple elastic bodies 421 may be provided along the arc circumferential surface, as illustrated in FIG. 33. FIG. 33 is a side view that illustrates the sheet supporting plate 420 according to the present embodiment in a main-scanning direction. If the sheet supporting plate 420 according to the present embodiment is configured in this manner, a pressing force can be uniformly applied to the entire area with the contact width Q of the fold-enhancing roller 410 and the sheet supporting plate 420 and, even if the sheet 6 is misaligned in a sheet conveying direction during a fold-enhancing, it can be further ensured that a fold line is pressed.

Figure 34:
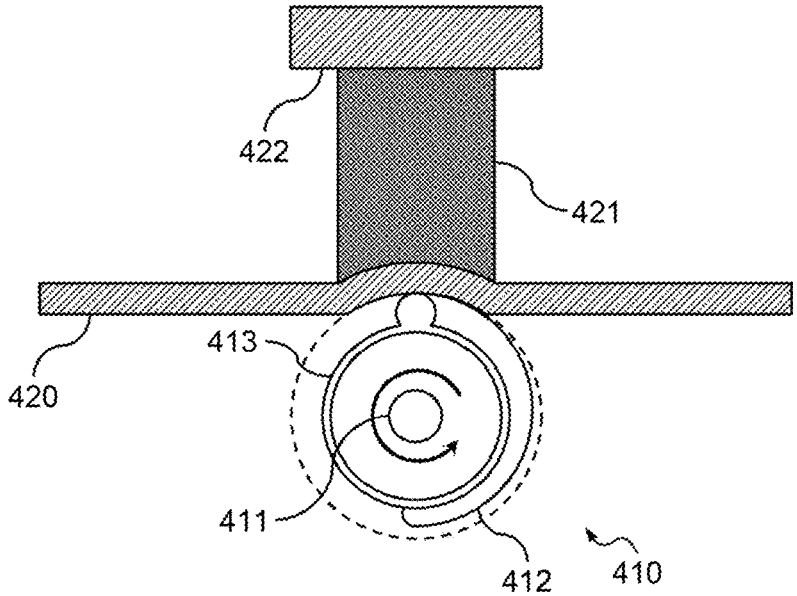
FIG. 34 is a side view that illustrates the sheet supporting plate according to the present embodiment in a main-scanning direction.

Furthermore, if the sheet supporting plate 420 according to the present embodiment is configured as illustrated in FIG. 32, the elastic body 421 may be provided so as to generate an elastic force on the entire area of the arc circumferential surface, as illustrated in FIG. 34. FIG. 34 is a side view that illustrates the sheet supporting plate 420 according to the present embodiment in a main-scanning direction. If the sheet supporting plate 420 according to the present embodiment is configured in this manner, a pressing force can be uniformly applied to the entire area with the contact width Q of the fold-enhancing roller 410 and the sheet supporting plate 420 and, even if the sheet 6 is misaligned in a sheet conveying direction during a fold-enhancing, it can be further ensured that a fold line is pressed.

Figure 35:
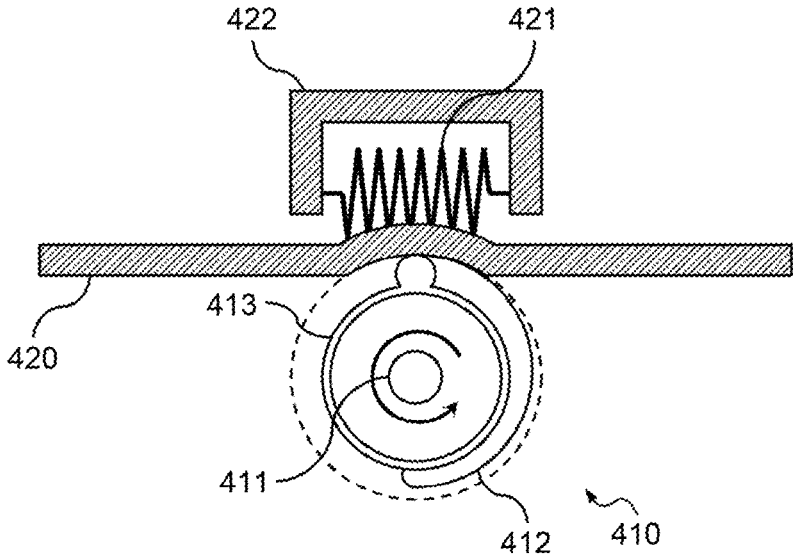
FIG. 35 is a side view that illustrates the sheet supporting plate according to the present embodiment in a main-scanning direction.

Furthermore, if the sheet supporting plate 420 according to the present embodiment is configured as illustrated in FIG. 32, the elastic body 421 which is laterally bridged in a circumferential direction so as to surround the arc circumferential surface, may be provided as illustrated in FIG. 35. FIG. 35 is a side view that illustrates the sheet supporting plate 420 according to the present embodiment in a main-scanning direction. If the sheet supporting plate 420 according to the present embodiment is configured in this manner, a pressing force can be uniformly applied to the entire area with the contact width Q of the fold-enhancing roller 410 and the sheet supporting plate 420 and, even if the sheet 6 is misaligned in a sheet conveying direction during a fold-enhancing, it can be further ensured that a fold line is pressed.

Figure 36:
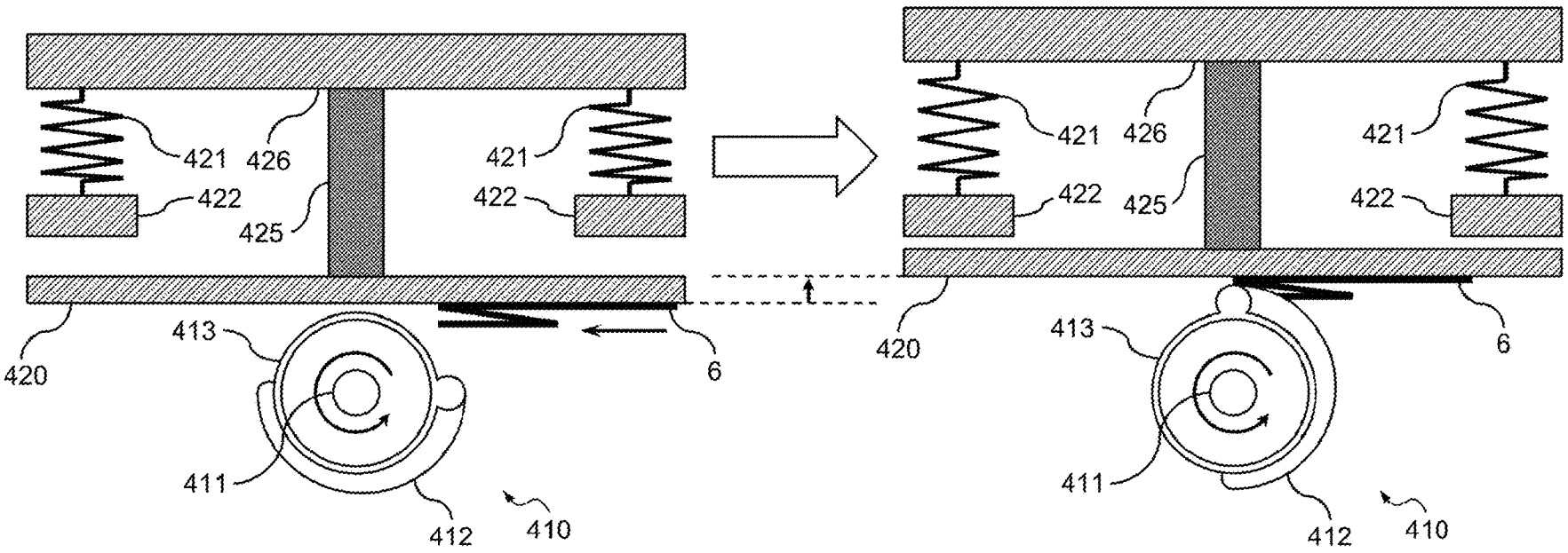
FIG. 36 is a side view that illustrates the sheet supporting plate according to the present embodiment in a main-scanning direction.

An explanation is given of a case of the configuration in which a force acts so that the sheet supporting plate 420 according to the present embodiment is pressed against the fold-enhancing roller 410 due to the elastic force of the elastic body 421 that is compressed by the sheet supporting plate 420 and the fixing member 422, as illustrated in FIG. 16; however, a configuration may be such that a force acts so that the sheet supporting plate 420 is pressed against the fold-enhancing roller 410 due to the compression force of the elastic body 421 that is stretched by the fixing member 422 and a movable member 426 that is connected to the sheet supporting plate 420 via a connection member 425 so as to move by linking to the sheet supporting plate 420, as illustrated in FIG. 36. FIG. 36 is a side view that illustrates the sheet supporting plate 420 according to the present embodiment in a main-scanning direction.

Figure 37:
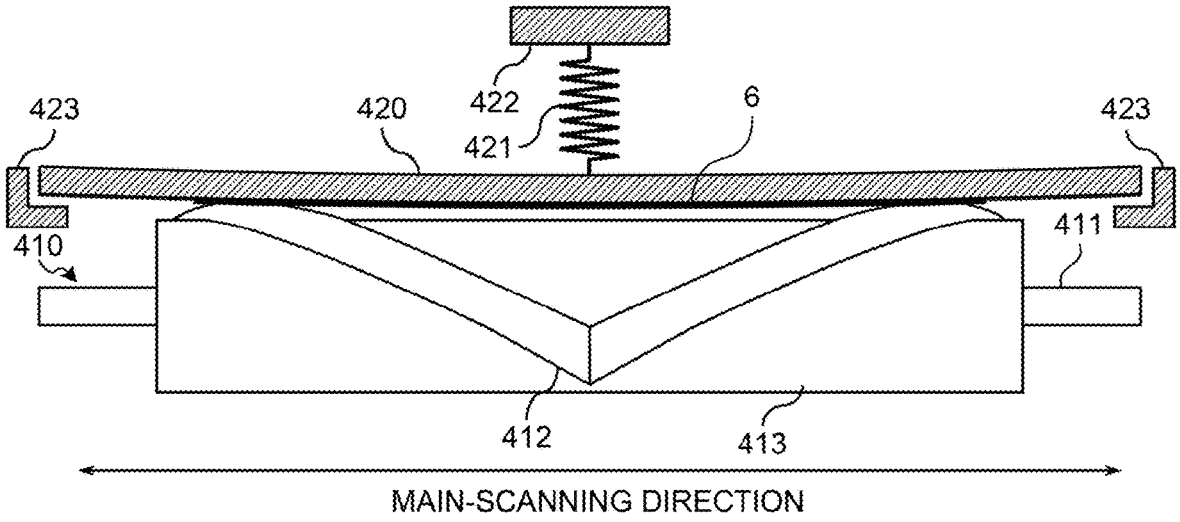
FIG. 37 is a front view that illustrates the sheet supporting plate according to the present embodiment during the normal time in a sub-scanning direction.

With regard to an area of the sheet supporting plate 420 according to the present embodiment on which the pressing force of the fold-enhancing roller 410 does not act during a fold-enhancing, moments occur toward the fold-enhancing roller 410 due to the elastic force of the elastic body 421; therefore, there is a possibility that the sheet supporting plate 420 is bent toward the fold-enhancing roller 410, as illustrated in FIG. 37. FIG. 37 is a front view that illustrates the sheet supporting plate 420 according to the present embodiment during the normal time in a sub-scanning direction. Therefore, in the fold-enhancing processing unit 4 according to the present embodiment, the pressing force is concentrated on the bent area that is not in contact with a fold line in the above state, and therefore a sufficient pressing force cannot be applied to a fold line.

Figure 38:
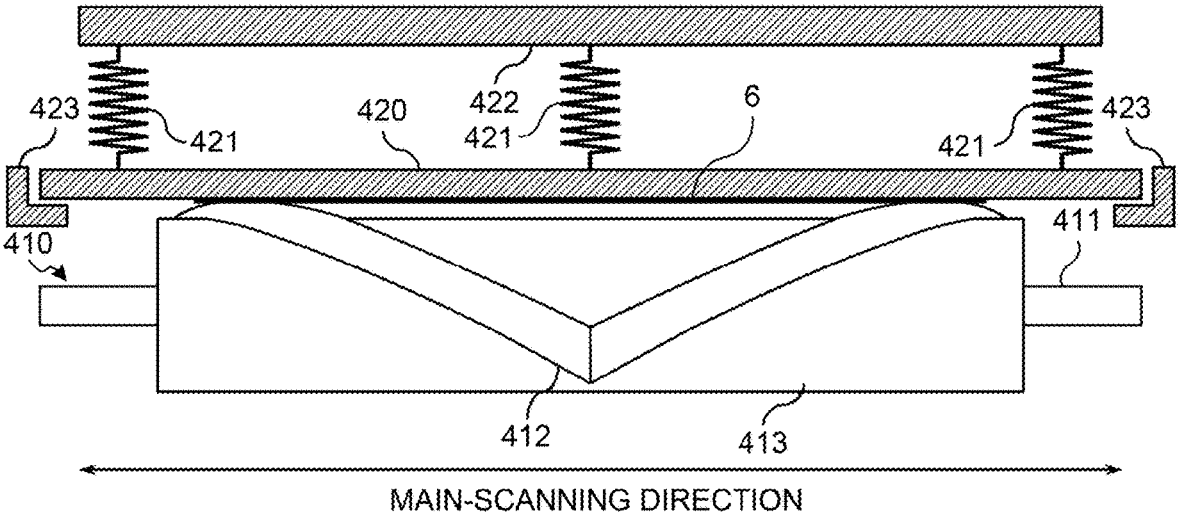
FIG. 38 is a front view that illustrates the sheet supporting plate according to the present embodiment during the normal time in a sub-scanning direction.

Then, it is possible to prevent the area that is not in contact with a fold line from being bent and to uniformly apply a sufficient pressing force to the entire area in a main-scanning direction by providing multiple elastic bodies 421 in a main-scanning direction in the sheet supporting plate 420 according to the present embodiment as illustrated in FIG. 38. FIG. 38 is a front view that illustrates the sheet supporting plate 420 according to the present embodiment during the normal time in a sub-scanning direction.

Figure 39:
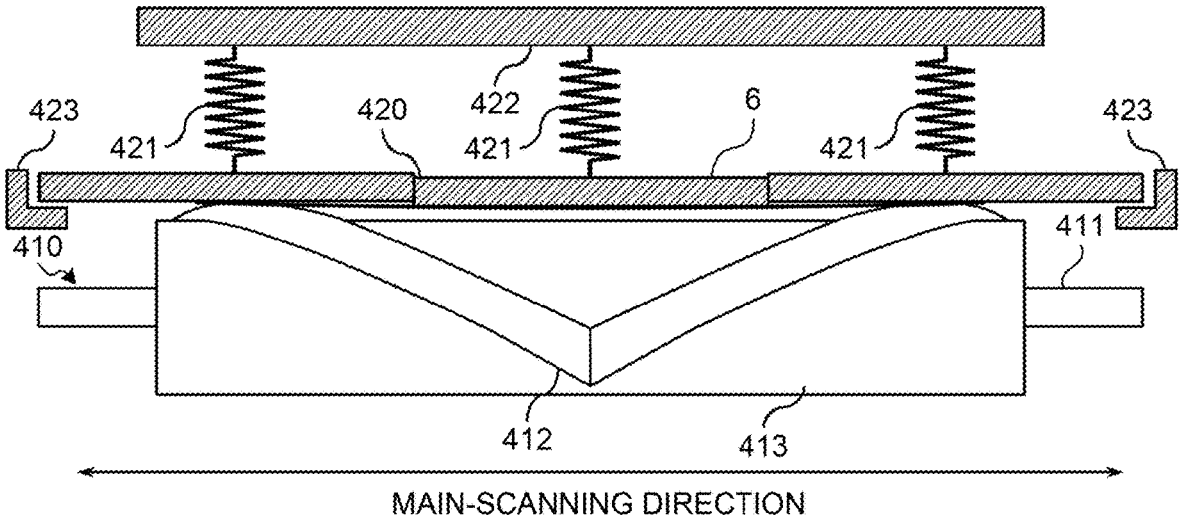
FIG. 39 is a front view that illustrates the sheet supporting plate according to the present embodiment during the normal time in a sub-scanning direction.

Furthermore, a configuration may be such that the multiple elastic bodies 421 are provided in a main-scanning direction and the sheet supporting plate 420 according to the present embodiment is divided into multiple pieces for the respective elastic bodies 421, as illustrated in FIG. 39. If the sheet supporting plate 420 according to the present embodiment is configured as illustrated in FIG. 39, each of the divided pieces of the sheet supporting plate 420 can apply a pressing force to a fold line individually; therefore, it is possible to prevent an area that is not in contact with a fold line from being bent and to uniformly apply a sufficient pressing force to the entire area in a main-scanning direction. FIG. 39 is a front view that illustrates the sheet supporting plate 420 according to the present embodiment during the normal time in a sub-scanning direction.

An explanation is given of a case where the fold-enhancing roller 410 according to the present embodiment is configured such that the pressing-force transmission section 412 is arranged along the main-scanning direction in a helical fashion with the certain angle difference θ from the fold-enhancing roller rotary shaft 411 on the peripheral surface of the pressing-force transmission roller 413 as illustrated in FIGS. 8 to 11, or the protruding pressing-force transmission section 412 is arranged in a helical fashion with the certain angle difference θ from the fold-enhancing roller rotary shaft 411 on the peripheral surface of the pressing-force transmission roller 413 and is arranged along a main-scanning direction in a V shape that is symmetrical about the center of the fold-enhancing roller 410 in a main-scanning direction, as illustrated in FIGS. 8 to 15.

Figure 40:
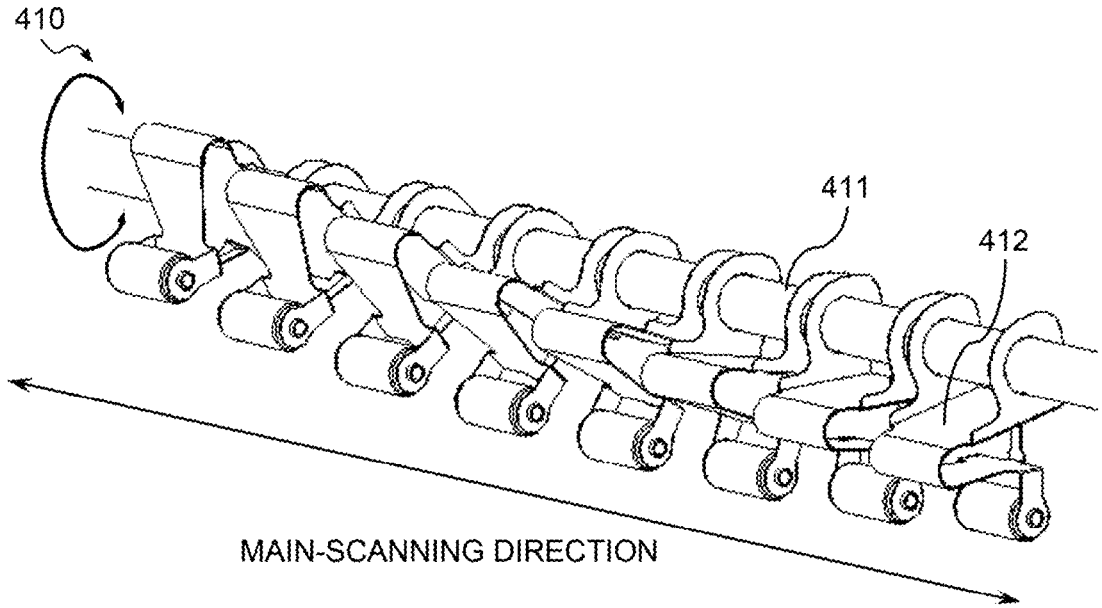
FIG. 40 is a perspective view that illustrates the fold-enhancing roller according to the present embodiment in a main-scanning direction and obliquely from the above.
Figure 41:
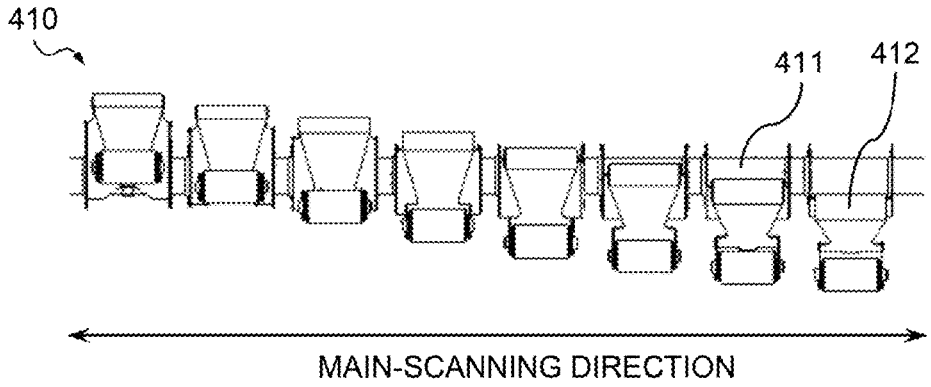
FIG. 41 is a front view that illustrates the fold-enhancing roller according to the present embodiment in a sub-scanning direction.
Figure 42:
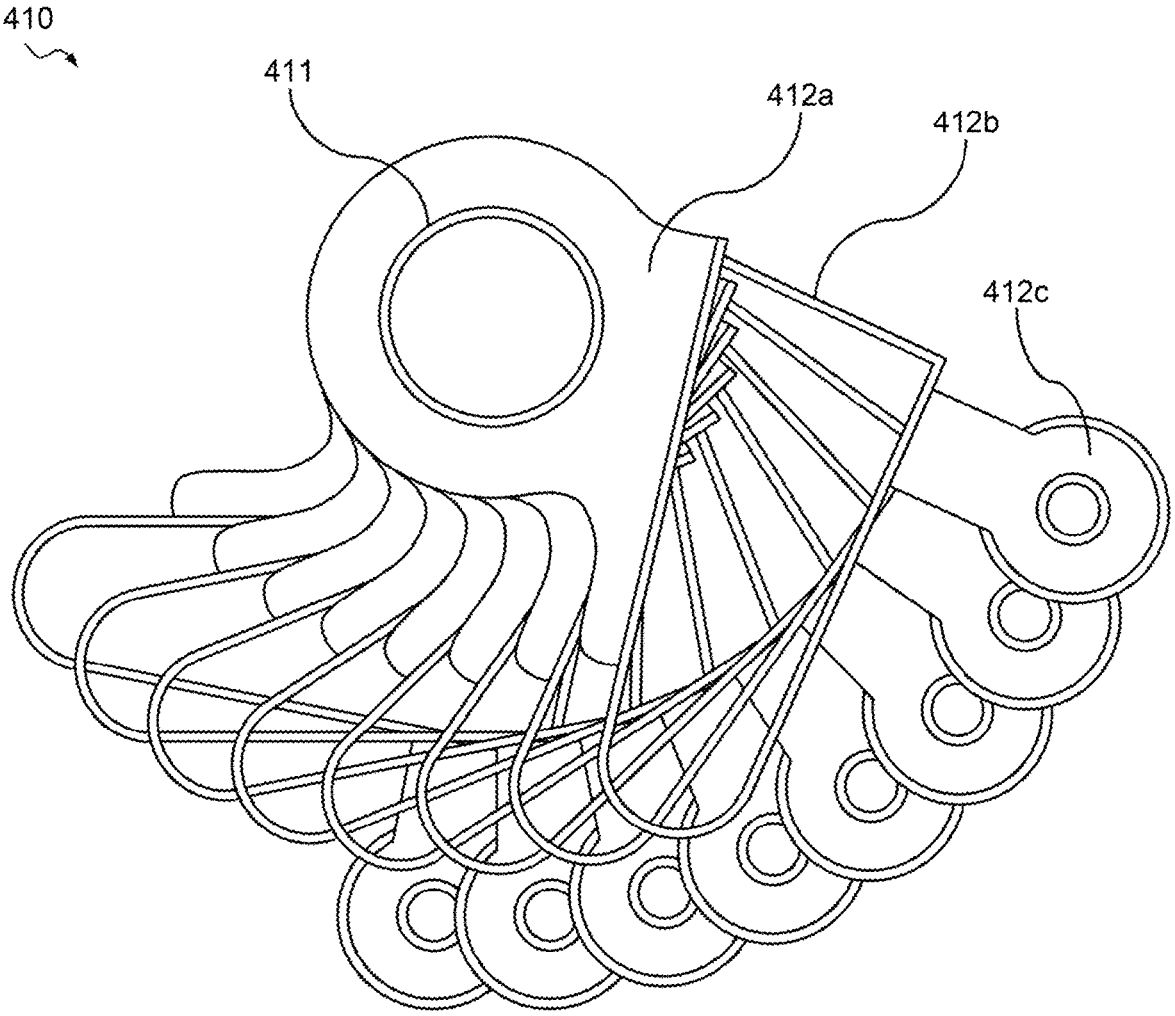
FIG. 42 is a side view that illustrates the fold-enhancing roller according to the present embodiment in a main-scanning direction.
Figure 43:
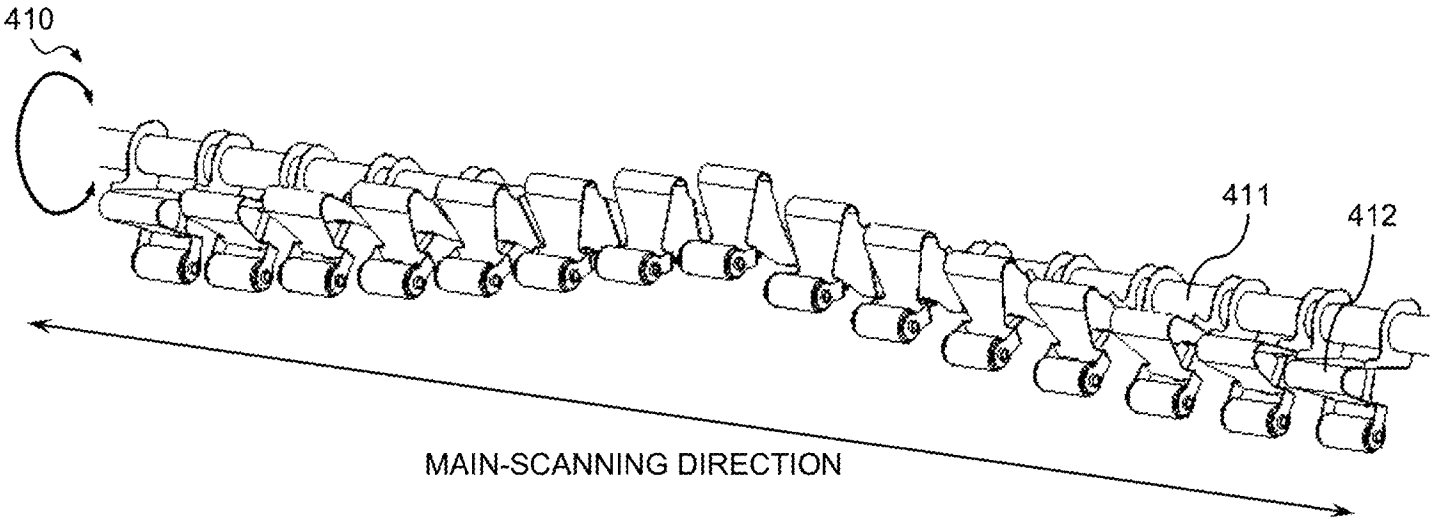
FIG. 43 is a perspective view that illustrates the fold-enhancing roller according to the present embodiment in a main-scanning direction and obliquely from the above.
Figure 44:
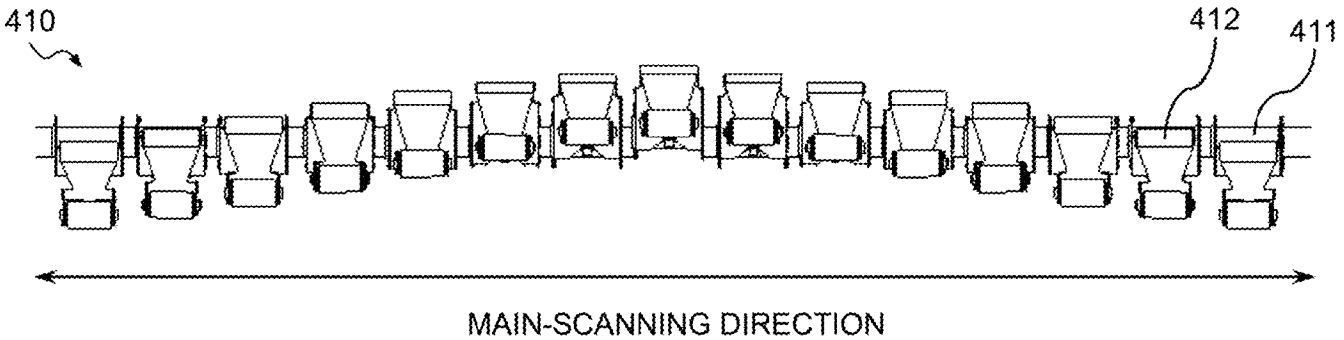
FIG. 44 is a front view that illustrates the fold-enhancing roller according to the present embodiment in a sub-scanning direction.
Figure 45:
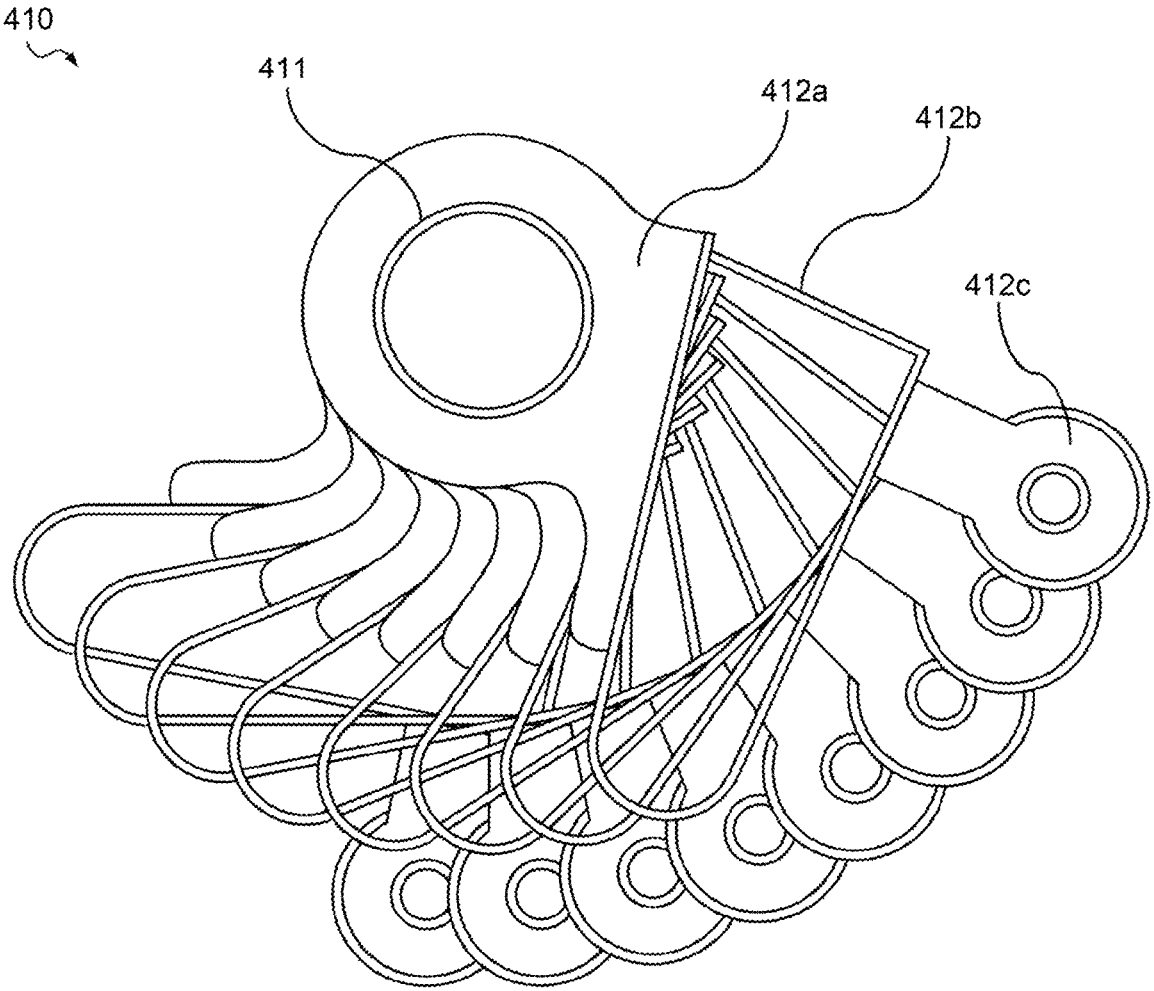
FIG. 45 is a side view that illustrates the fold-enhancing roller according to the present embodiment in a main-scanning direction.
Figure 46:
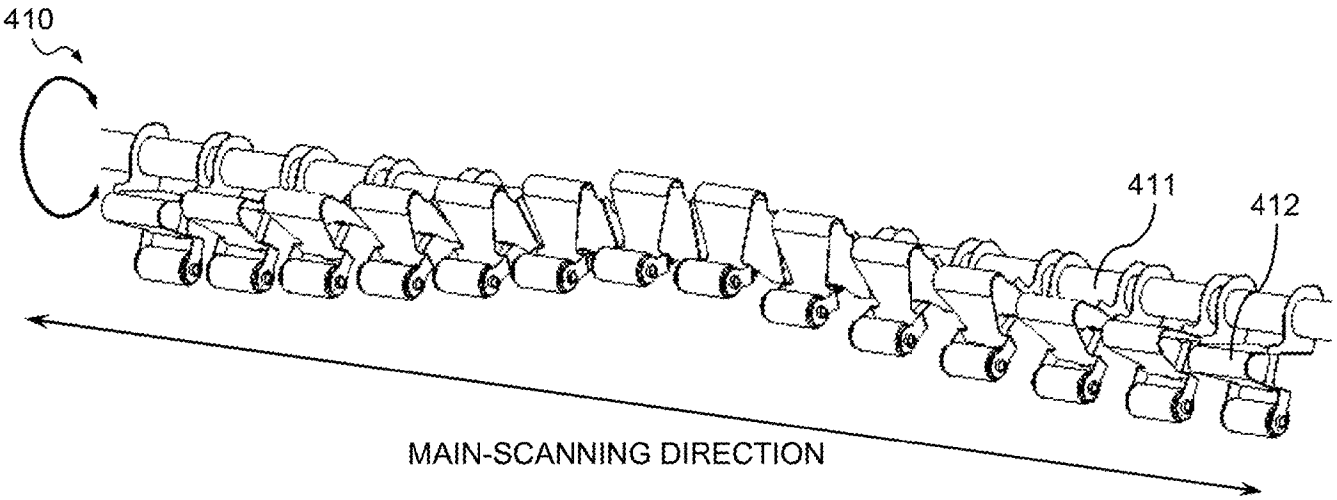
FIG. 46 is a perspective view that illustrates the fold-enhancing roller according to the present embodiment in a main-scanning direction and obliquely from the above.
Figure 47:
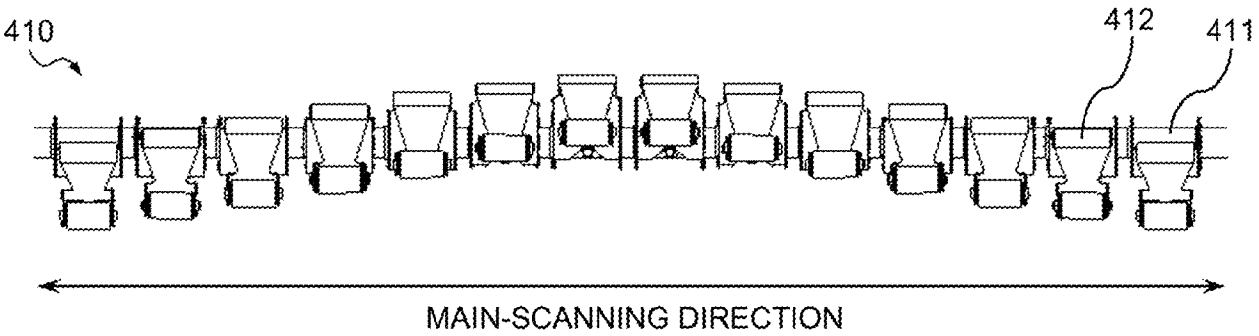
FIG. 47 is a front view that illustrates the fold-enhancing roller according to the present embodiment in a sub-scanning direction.
Figure 48:
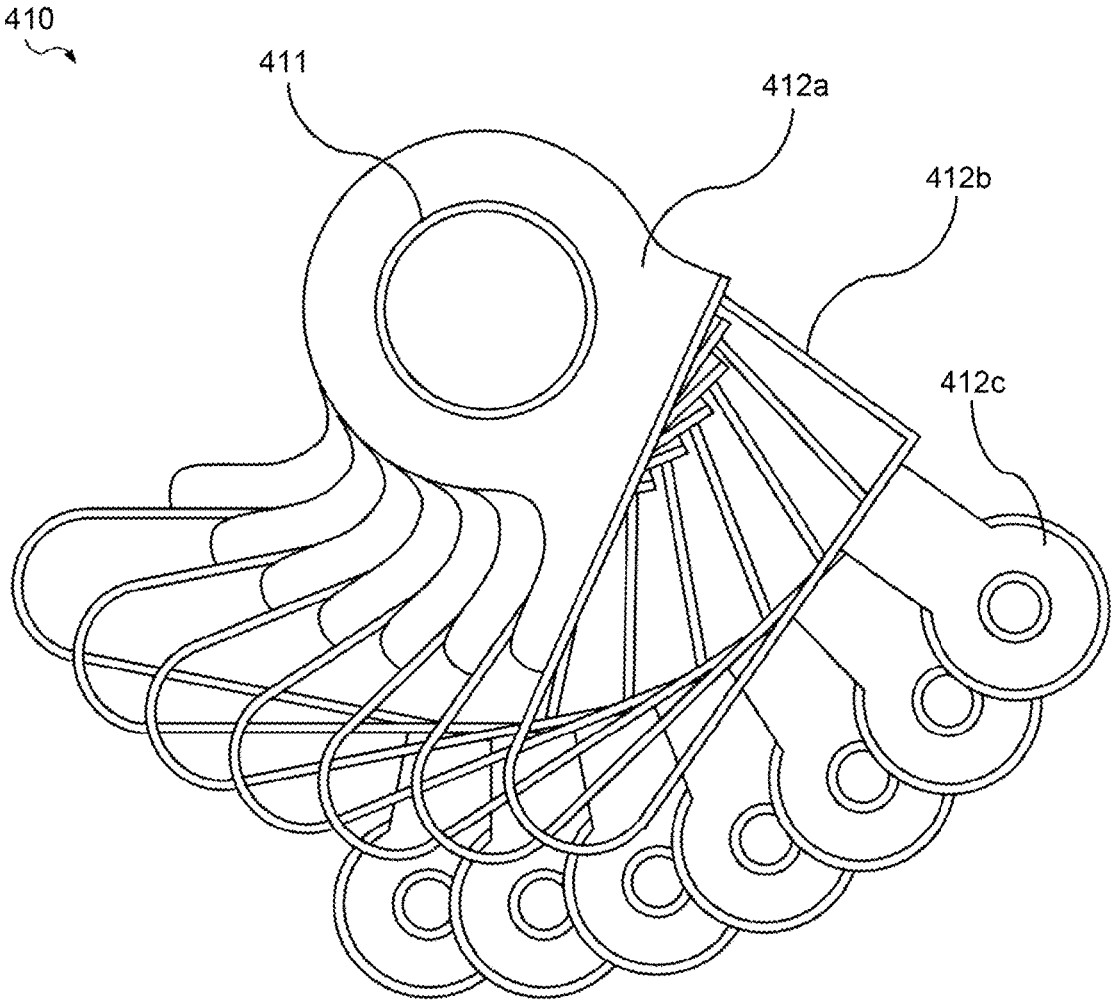
FIG. 48 is a side view that illustrates the fold-enhancing roller according to the present embodiment in a main-scanning direction.

Alternatively, the fold-enhancing roller 410 according to the present embodiment may be configured such that, as illustrated in FIGS. 40 to 42, the multiple pressing-force transmission sections 412 are provided around the fold-enhancing roller rotary shaft 411 with a constant interval in a main-scanning direction with a certain angle difference from one another in the rotation direction of the fold-enhancing roller rotary shaft 411.

Alternatively, the fold-enhancing roller 410 according to the present embodiment may be configured such that, as illustrated in FIGS. 43 to 45 or FIGS. 46 to 48, the odd or even number of the pressing-force transmission sections 412 are provided around the fold-enhancing roller rotary shaft 411 with a constant interval in a main-scanning direction with a certain angle difference from one another in the rotation direction of the fold-enhancing roller rotary shaft 411 such that they are symmetric about the center of the fold-enhancing roller rotary shaft 411 in a main-scanning direction.

With the configuration of the fold-enhancing roller 410 according to the present embodiment as illustrated in FIGS. 40 to 42, FIGS. 43 to 45, and FIGS. 46 to 48, the loads on the fold-enhancing roller rotary shaft 411 can be reduced, a sufficient pressing force can be applied to a fold line without decreasing the productivity, and the occurrence of a fold crease on the sheet 6 can be prevented.

Figure 49:
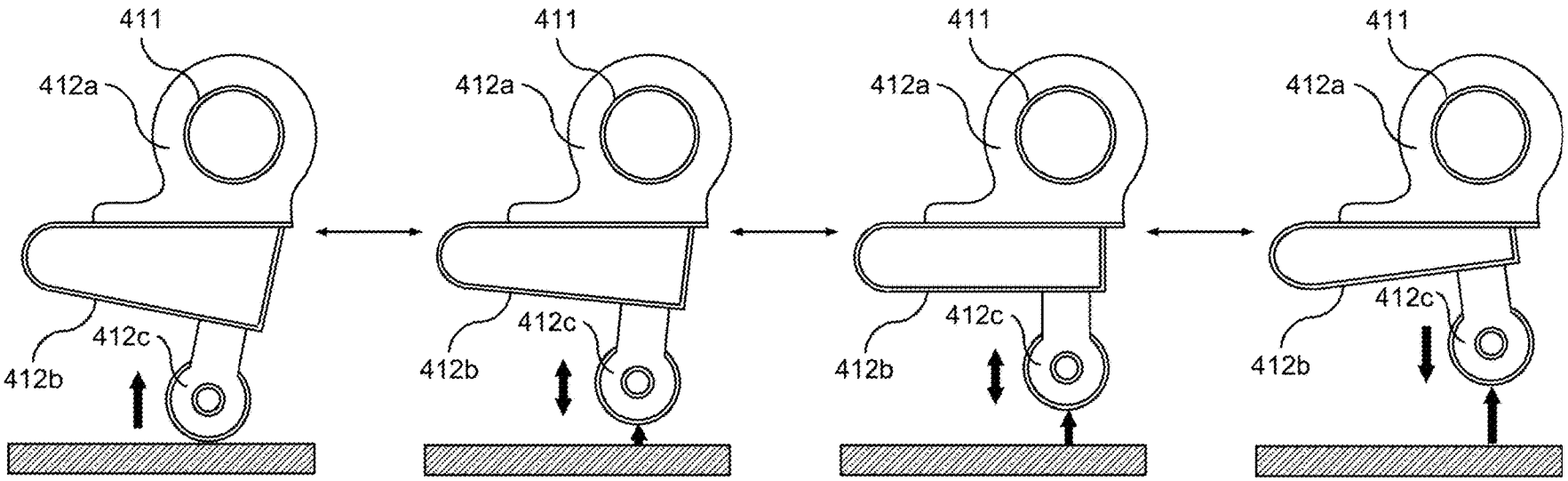
FIG. 49 is a diagram that illustrates, in a main-scanning direction, a state where a pressing-force transmission section according to the present embodiment is provided on a fold-enhancing roller rotary shaft.

Here, an explanation is given, with reference to FIG. 49, of an example of the structure of the pressing-force transmission section 412 in the case of this configuration. FIG. 49 is a diagram that illustrates, in a main-scanning direction, a state where the pressing-force transmission section 412 according to the present embodiment is provided on the fold-enhancing roller rotary shaft 411. As illustrated in FIG. 49, the pressing-force transmission section 412 according to the present embodiment includes a fixing section 412*a* that fixes the pressing-force transmission section 412 around the fold-enhancing roller rotary shaft 411; an elastic member 412*b* that is attached to the fixing section 412*a* and that is expanded and/or contracted to generate an elastic force in the expansion and contraction direction; and a pressing roller 412*c* that is attached to the elastic member 412*b* and that is formed with a rotary body that rotates about the axis that extends in a main-scanning direction.

The reason why the pressing-force transmission section 412 includes the elastic member 412*b* as described above is that, if it is assumed that the elastic member 412*b* is a rigid member, the fold-enhancing roller 410 is prevented from rotating when any of the pressing-force transmission sections 412 is brought into contact with the sheet supporting plate 420.

FIG. 49 illustrates a case where the elastic member 412*b* is made of a plate spring; however, it may be made of a different material that has elasticity, such as a compression spring, rubber, sponge, or plastic resin.

In the fold-enhancing processing unit 4 according to the present embodiment, during a fold-enhancing operation, the fold-enhancing roller 410 that is configured in this manner is rotated about the fold-enhancing roller rotary shaft 411 that is a rotation axis, whereby a fold line that is formed on a sheet in a main-scanning direction can be sequentially pressed by each of the pressing-force transmission sections 412 in the direction of the fold line.

This is because the fold-enhancing roller 410 according to the present embodiment is configured such that the multiple pressing-force transmission sections 412 are provided with a certain interval in a main-scanning direction on the circumference of the fold-enhancing roller rotary shaft 411 with a certain angle difference from one another in the rotation direction of the fold-enhancing roller rotary shaft 411.

Thus, in the fold-enhancing processing unit 4 according to the present embodiment, the pressing force is not distributed over the entire area in a main-scanning direction during a fold-enhancing operation, and an intensive pressing force of each of the pressing-force transmission sections 412 can be applied to the entire area of a fold line.

Figure 50:
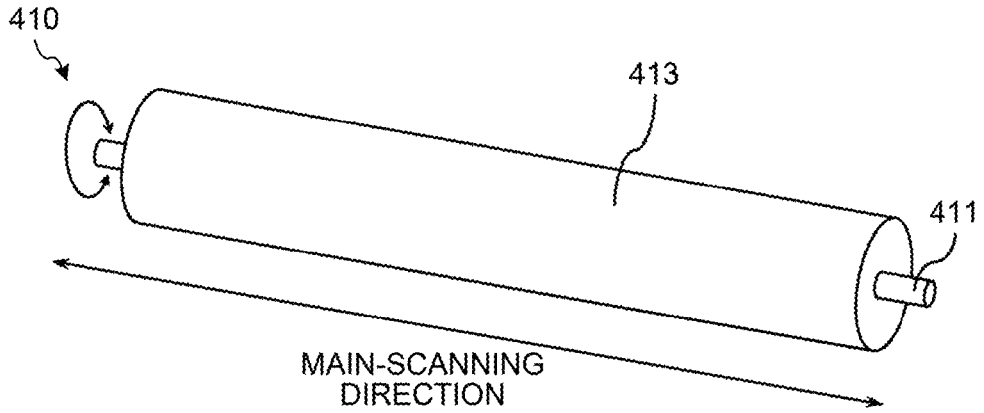
FIG. 50 is a perspective view that illustrates the fold-enhancing roller according to the present embodiment in a main-scanning direction and obliquely from the above.

Furthermore, instead of the above configuration, the fold-enhancing roller 410 according to the present embodiment may be configured such that the pressing-force transmission roller 413 is simply secured to the fold-enhancing roller rotary shaft 411, as illustrated in FIG. 50. FIG. 50 is a perspective view that illustrates the fold-enhancing roller 410 according to the present embodiment in a main-scanning direction and obliquely from the above. In FIG. 50, the pressing-force transmission roller 413 is the roller for transmitting a pressing force to a fold line that is formed on the sheet 6 by pressing the sheet 6 against the sheet supporting plate 420. If the fold-enhancing roller 410 according to the present embodiment is configured in this manner, the entire area of a fold line can be pressed in a main-scanning direction just by being pressed against the sheet supporting plate 420 without rotating.

Furthermore, according to the present embodiment, an explanation is given of the configuration in which the image forming apparatus 1 includes the image forming unit 2, the folding processing unit 3, the fold-enhancing processing unit 4, and the scanner unit 5; however, each unit may be configured as a different separate device, and an image forming system may be configured by connecting the devices.

According to an embodiment, it is possible to effectively enhance a fold line that is formed on a sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a shaft; and a press member, the sheet processing apparatus being configured to press a fold line formed on a sheet, with the press member, wherein the press member includes a contact part arranged such that a pressing position in which the contact part presses the fold line, sequentially changes in an axial direction of the shaft with rotation of the shaft, and the contact part is configured to, with rotation of the press member about the shaft, approach the fold line from a sheet surface closer to the shaft among two sheet surfaces forming the fold line, wherein the press member is configured to be rotatable in only one direction when pressing the fold line.

2. The sheet processing apparatus according to claim 1, wherein the contact part is configured to sequentially press the fold line in a direction of the fold line.

3. The sheet processing apparatus according to claim 1, wherein the contact part is configured to press a whole range of the fold line with no break.

4. The sheet processing apparatus according to claim 1, further comprising a sheet abutting plate configured to abut on the sheet in a position opposite to the press member across the sheet.

5. The sheet processing apparatus according to claim 4, wherein the contact part and the sheet abutting plate are arranged such that the contact part is below and the sheet abutting plate is above in a gravity direction.

6. The sheet processing apparatus according to claim 1, wherein the contact part includes a plurality of contact parts arranged in the axial direction of the shaft.

7. The sheet processing apparatus according to claim 1, wherein the contact part is arranged on the shaft via an elastic member.

8. The sheet processing apparatus according to claim 1, wherein the sheet is stopped when pressing the fold line of the sheet.

9. The sheet processing apparatus according to claim 1, wherein a rotational direction of the shaft is one direction.

10. The sheet processing apparatus according to claim 1, further comprising:

a rotation driving and braking unit configured to generate a driving force to rotate the contact part, and a braking force to stop rotation of the contact part; and a driving force intercepting unit configured to transmit, to the contact part, only a driving force rotating the contact part in a specific direction among the driving force generated by the rotation driving and braking unit, and intercept, from the contact part, a driving force rotating the contact part in an opposite direction to the specific direction, wherein the contact part is configured to rotate about an axis perpendicular to a direction in which the sheet is conveyed, and parallel to the sheet surface, to press the fold line.

11. The sheet processing apparatus according to claim 10, further comprising a different drive transmitting unit configured to transmit, to a different driving unit, the driving force intercepted from the contact part.

12. The sheet processing apparatus according to claim 10, wherein the driving force intercepting unit is configured to transmit, to the contact part, only the driving force rotating the contact part in a rotational direction when the contact part presses the fold line of the sheet, and intercept, from the contact part, a driving force rotating the contact part in an opposite direction to the rotational direction.

13. An image forming system, comprising:

an image forming apparatus configured to form an image on the sheet; and the sheet processing apparatus according to claim 1, the sheet processing apparatus being configured to form the fold line on the sheet on which an image is formed by the image forming apparatus, and press the fold line.

14. A sheet processing method in a sheet processing apparatus including a shaft, a press member, and a sheet abutting plate, configured to press a fold line formed on a sheet, with the press member, wherein the press member includes a contact part arranged such that a pressing position in which the contact part presses the fold line against the sheet abutting plate, sequentially changes in an axial direction of the shaft with rotation of the shaft, and the contact part is made to, with rotation of the press member about the shaft, approach the fold line from a sheet surface closer to the shaft among two sheet surfaces forming the fold line.

15. A sheet processing apparatus, comprising:

a shaft; and a press member, the sheet processing apparatus being configured to press a fold line formed on a sheet, with the press member, wherein the press member includes a contact part arranged such that a pressing position in which the contact part presses the fold line, sequentially changes in an axial direction of the shaft with rotation of the shaft, and the contact part is configured to, with rotation of the press member about the shaft, approach the fold line from a sheet surface closer to the shaft among two sheet surfaces forming the fold line, wherein the contact part presses the fold line of a stopped sheet sequentially in a direction along the fold line.

* * * * *